United States Patent [19]

Sato et al.

[11] 4,121,424

[45] Oct. 24, 1978

[54] METHOD OF STARTING UP TURBINES

[75] Inventors: Yoshio Sato; Mistuyo Nishikawa, both of Hitachi, Japan

[73] Assignee: Hitachi, Ltd., Japan

[21] Appl. No.: 768,754

[22] Filed: Feb. 15, 1977

[30] Foreign Application Priority Data

Feb. 16, 1976 [JP] Japan ..... 51-14907

[51] Int. Cl.[2] ..... F01K 13/02

[52] U.S. Cl. ..... 60/646; 60/657; 60/660; 415/17; 415/30; 364/300

[58] Field of Search ..... 60/656, 646, 657, 660; 415/13, 15, 17, 30, 36, 47; 364/300

[56] References Cited

U.S. PATENT DOCUMENTS

| | | | |
|---|---|---|---|
| 3,446,224 | 5/1969 | Zwicky | 415/17 |
| 3,561,216 | 2/1971 | Moore | 60/646 X |
| 3,577,733 | 5/1971 | Manuel | 60/646 |
| 3,588,265 | 6/1971 | Berry | 415/17 X |
| 3,928,972 | 12/1975 | Osborne | 60/646 |

*Primary Examiner*—Allen M. Ostrager
*Attorney, Agent, or Firm*—Craig & Antonelli

[57] ABSTRACT

At the point of time to when the turbine speed has come up to a first speed $N_1$, a thermal stress expected in the turbine when the speed is increased to a second speed $N_2$ at a rate $\alpha_1$ is presumed. Thermal stress $\sigma_{s(t)}-\sigma_{sT1}$ at the point of time $t_{o1}$ for commencing acceleration to the second speed $N_2$ is then obtained, which point of time $t_{o1}$ would never cause the maximum value of the presumed thermal stress to exceed a predetermined limit $\sigma_{sl}$ of the thermal stress when the turbine speed is increased at that rate. Then, a length of time $T_{w1}$, referred to as a warming time, is determined which is required for the thermal stress $\sigma_{s(t)}$ to decrease to the level of $(\sigma_{s(t)}-\sigma_{sT1})$ when the warming is continued after the point of time $t_o$. Subsequently, a length of time $(N_2-N_1)/\alpha_1$ required for increasing the turbine speed from $N_1$ to $N_2$ at the rate $\alpha_1$ is calculated. The sum of the warming time $T_w$ and the time $(N_2-N_1)/\alpha_1$ required for acceleration is calculated. The lengths of time for starting $T_1$, $T_2$, $T_3$ are found for each of the acceleration rates $\alpha_1$, $\alpha_2$, $\alpha_3$ in speed. The acceleration of the turbine is commenced at the time and with the rate which in combination provide the smallest sum T of time.

36 Claims, 20 Drawing Figures

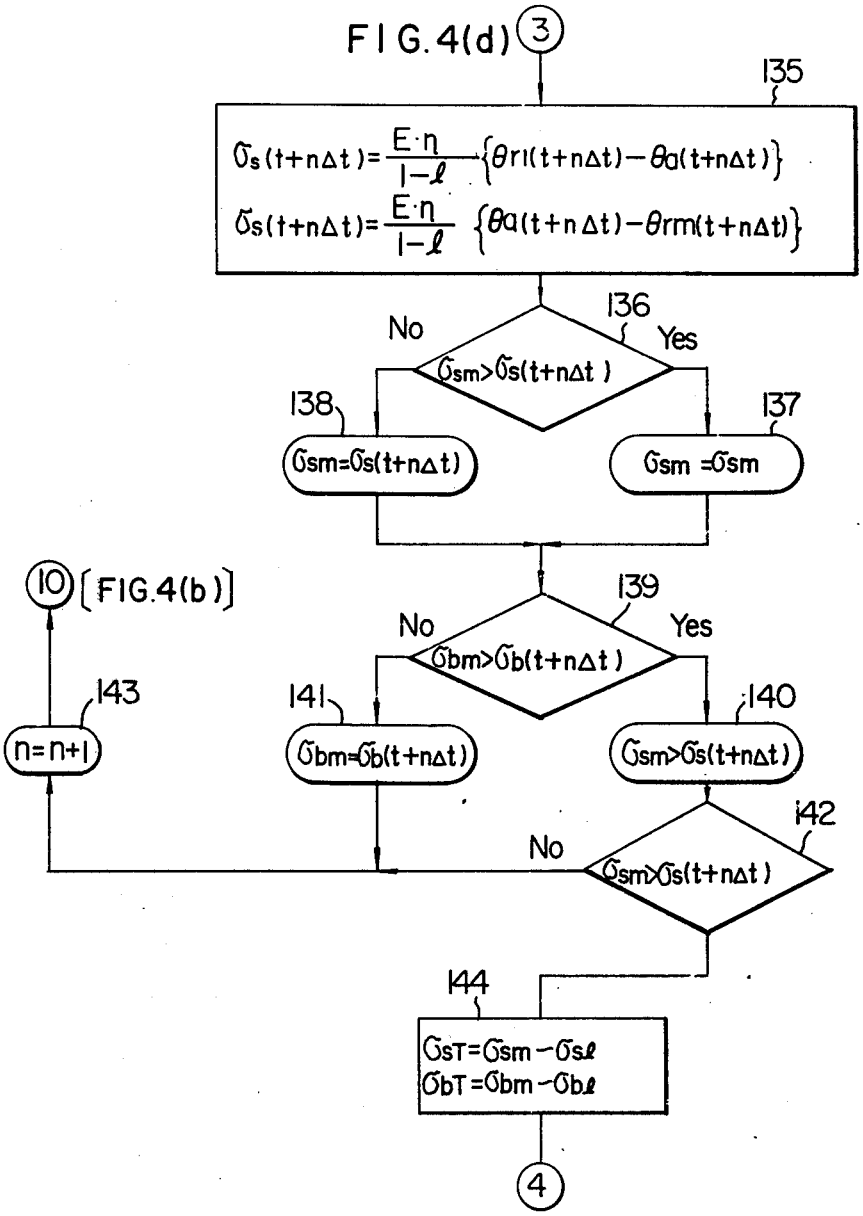
FIG.4(d)
3
135
$\sigma_s(t+n\Delta t)=\frac{E\cdot\eta}{1-\ell}\{\theta r1(t+n\Delta t)-\theta a(t+n\Delta t)\}$
$\sigma_s(t+n\Delta t)=\frac{E\cdot\eta}{1-\ell}\{\theta a(t+n\Delta t)-\theta rm(t+n\Delta t)\}$
136
No
Yes
$\sigma_{sm}>\sigma_s(t+n\Delta t)$
138
137
$\sigma_{sm}=\sigma_s(t+n\Delta t)$
$\sigma_{sm}=\sigma_{sm}$
10
[FIG.4(b)]
139
No
Yes
$\sigma_{bm}>\sigma_b(t+n\Delta t)$
143
141
140
$n=n+1$
$\sigma_{bm}=\sigma_b(t+n\Delta t)$
$\sigma_{sm}>\sigma_s(t+n\Delta t)$
142
No
$\sigma_{sm}>\sigma_s(t+n\Delta t)$
144
$\sigma_{sT}=\sigma_{sm}-\sigma_{s\ell}$
$\sigma_{bT}=\sigma_{bm}-\sigma_{b\ell}$
4

F.I.G.5
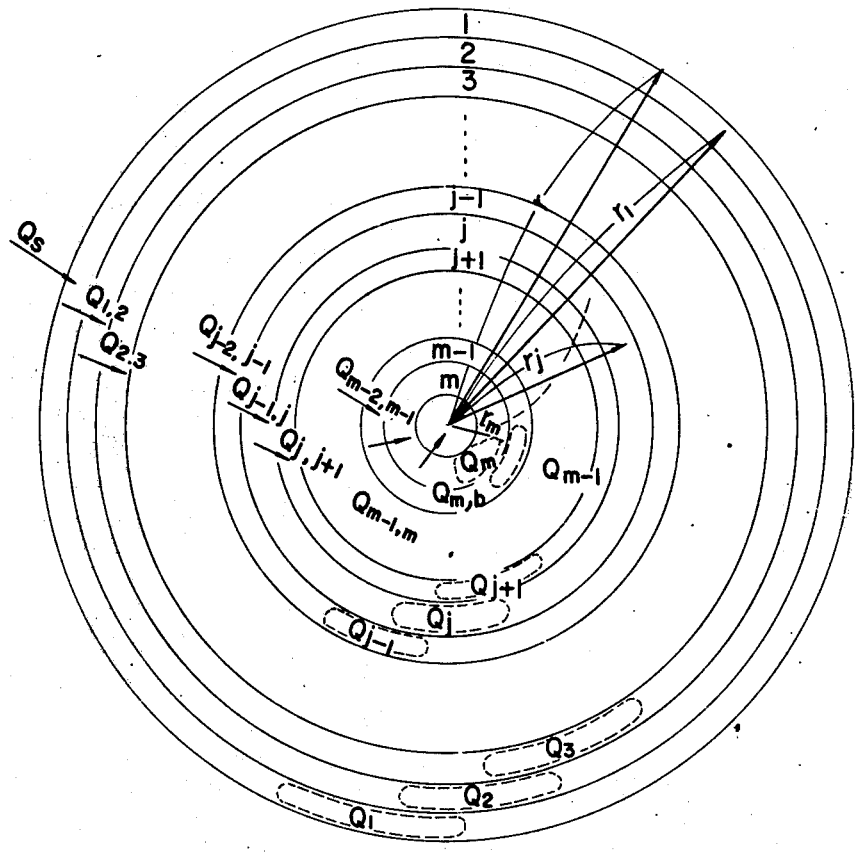

LARGE
PRESSURE OF MAIN-STEAM P
SMALL
ENTHALPY H
MAIN-STEAM TEMPERATURE θ

SMALL
PRESSURE OF MAIN-STEAM P
LARGE
F FLOW RATE OF MAIN-STEAM
TURBINE SPEED N

LARG
FLOW RATE OF STEAM F
SMALL
θ MAIN-STEAM TEMPERATURE DOWNSTREAM OF THE FIRST STAGE
ENTHALPY H

START
INPUT N, θ, P AND θ2
H=f(Q.P)
201
119
135
FIG.4(a)~4(e)
σas=σs(t) e^-Δt/τo
σbs=σb(t) e^-Δt/τo
202
203
σs−Δσ ≦ σas ≦ σs+Δσ
σb−Δσ ≦ σab ≦ σb+Δσ
No
Yes
205
CONTROL THE MAIN-STEAM TEMPERATURE
204
nΔt ≧ Tw
Yes
CONTROL THE SPEED-UP
206
1

METHOD OF STARTING UP TURBINES

BACKGROUND OF THE INVENTION

The present invention relates to a method of starting up turbines and, more particularly, to a method of starting up turbines in a minimum length of time without causing thermal stress in the turbine to exceed a predetermined limit during acceleration of the turbine or during the controlling of load on the turbine.

In general, in the course of acceleration and load control of the steam turbine, attention must be paid above all to thermal stresses generated in the turbine since thermal stresses are strictly limited from a view point of safety.

According to the recent technique of managing the turbine system, the thermal stresses are severely controlled to prolong the life of the turbine which may be shortened at each time of starting.

The thermal stresses generated in the turbine are closely related to the acceleration rate or to the rate of change in load and generally tend to become larger as the acceleration rate becomes larger.

Therefore, in order to restrain the thermal stresses within a predetermined range, the acceleration rate has become one of the serious considerations.

In general, in starting up the turbine, rolling-up and warming are effected alternatingly. Thus, thermal stresses are related also to the duration of warming. More specifically, thermal stresses are increased during acceleration and then are gradually decreased during the subsequent warming. The larger the thermal stresses, the longer the duration of warming.

Conventional thermal power plants have been normally run at their base loads to meet the requirements of the systems connected thereto, and have been kept going for several months without suspension once they are started. In this case, the turbine can be smoothly started so long as attention is paid to thermal stresses. Accordingly, the operation of the turbine is performed at a sufficiently slow acceleration rate with a sufficiently long length of time.

One the other hand, recent thermal power plants, in particular, those of small or medium scale of capacity have predominated which are operated with frequent cyclic starting and stopping. For example, according to a mode of operation called "Daily Start and Stop", boilers are set on at 5 A.M. every morning and the start-up of the turbines is completed at 8 A.M. The turbine is then operated whole through the day time until 10 P.M. This cyclic starting-up and stopping of the plant are repeated every day. In another mode called "Weekly Start and Stop", the plant is started up, for example, at 8 A.M. on Monday and works whole through the week until it is stopped at 10 P.M. on Saturday, which cyclic operation is repeated every week.

In these cases, it becomes important to minimize the length of time required for the starting-up, although the restraint of the thermal stress is of the ultimate importance.

For instance, supposing that a plant in which the starting-up must be completed at 8 A.M. fails to start at that time, disturbance due to shortage of power may be resulted in the system concerned. This disturbance can be overcome only through increasing the outputs of other plant or plants. Thus, it is strictly required that the plants must be at latest started by the time expected, e.g. at 8 A.M. which in turn necessitates minimum length of time for starting-up the turbine. In addition, when a thermal power plant is tripped due to accidents in the system out of the plant, the plant must be reset as soon as the source of the trouble in the system is removed, in which case the plant including boilers and turbines which remain still warm must be restarted within a minimum length of time by so-called rapid restart.

Thus, recently, a method of starting up turbines have been longed for, which can simultaneously satisfy two contradictive requirements of minimizing the length of time for the starting-up and limitting thermal stresses within an allowable range.

SUMMARY OF THE INVENTION

It is therefore an object of the invention to provide a method of starting up turbines which affords to minimize length of starting-up time restraining thermal stresses in the turbine within a predetermined allowable range, during the turbine acceleration or variation of load.

To this end, according to the present invention, there is provided a method of starting up turbines for acceleration or increasing the load on the turbine from a first stable operating condition to a second stable operating condition at a constant rate, said method comprising calculating and presuming a thermal stress expected to be resulted in the turbine when it is controlled at the rate, determining a length of time for warming for restraining a presumed maximum thermal stress within a level of a predetermined limit and then controlling the turbine for acceleration or for increasing the load at the rate from that instant.

These and other objects, as well as advantageous features of the invention will become more clear from the following description of a preferred embodiment taken in conjunction with the attached drawings in which:

BRIEF DESCRIPTION OF THE DRAWINGS

FIG. 5 is a concentric circular development of a turbine rotor, which is used for discussing the thermal stress generated in the rotor on a basis of a cylindrical coordinate;

DETAILED DESCRIPTION OF THE PREFERRED EMBODIMENT

Figure 1:
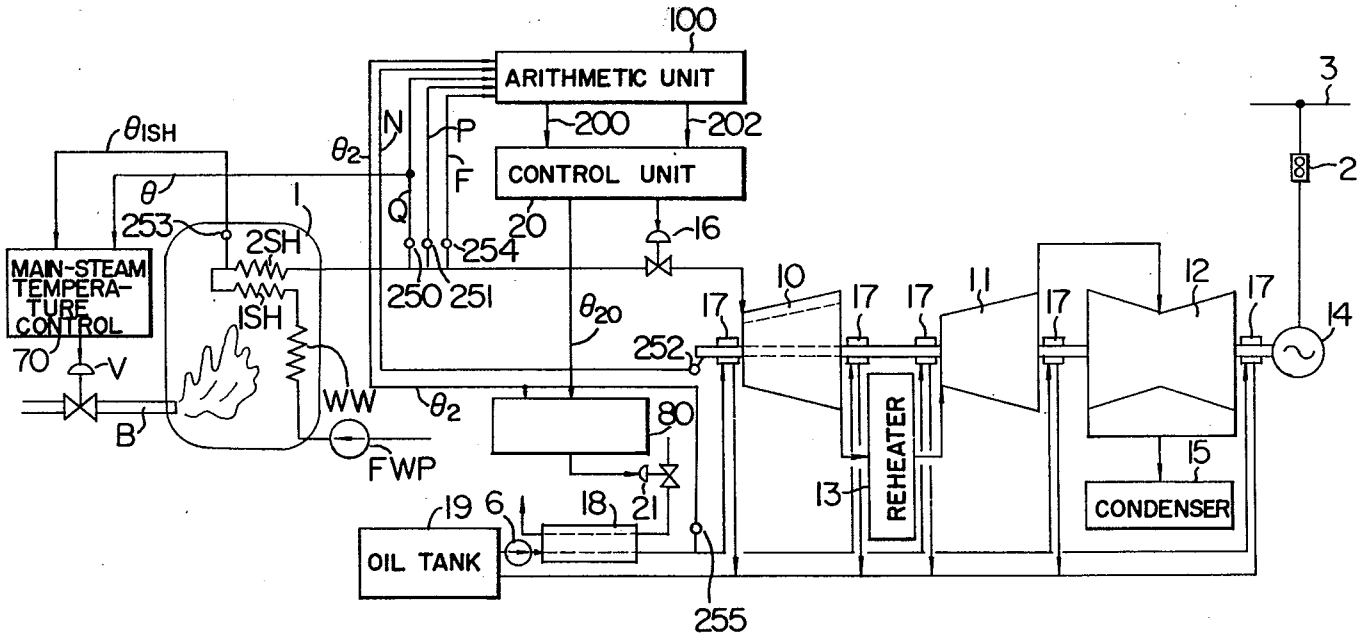
FIG. 1 schematically shows a thermal power plant, especially a turbine system to which the present invention is applicable, along with a turbine controlling system in accordance with the present invention.

Referring at first to FIG. 1, a steam turbine system to which the present invention is adapted to be applied is shown as having steam generating means which may be a boiler, a nuclear reactor or a steam converter or generator (referred to simply as "boiler") generally designated at a numeral 1. A feed water pump FWP is adapted to feed water to the boiler 1. The water thus fed is changed into steam as it passes as water-wall WW, a first superheater 1SH and a second superheater 2SH. Fuel is supplied to a burner B of the boiler 1 through a valve V which is adapted to be controlled by a main-steam temperature controller 70 constituting a part of an automatic boiler control system. The steam thus generated is fed to a high-pressure turbine 10 via turbine control valves 16. The steam having expanded through the high-pressure turbine to drive same is then reheated by a reheater 13, and is then directed to an intermediate-pressure turbine 11 and then to a low-pressure turbine 12 to expand therethrough for performing the work. The turbines 10, 11 and 12 are directly connected to a generator 14 to drive same for producing some electric output. The steam discharged from the low-pressure turbine 12 is then cooled and becomes a condensate water in a condenser 15.

The arrangement of the high, intermediate and low pressure turbines, as well as of associated equipments does not constitute a part of the invention, so that no further description is made here.

The weights of the turbines 10, 11 and 12 are born by a plurality of bearings 17 to be supplied with lubricating oil from an oil tank 19 by means of a lubricating oil pump 6. Since the lubricating oil supplied to the bearings is heated by heat resulted from frictional sliding engagement of a rotor shaft with the bearing surface, a certain decrease in viscosity of the lubricating oil is inevitably resulted. To compensate for this, an oil cooler 18 is provided for cooling the lubricating oil entering the bearings 17. The flow rate of cooling medium passing through the oil cooler 18 is controlled dependent upon the opening degree of a valve 21.

The above is a general description of a turbine system to which the present invention is applied.

Figure 2A:
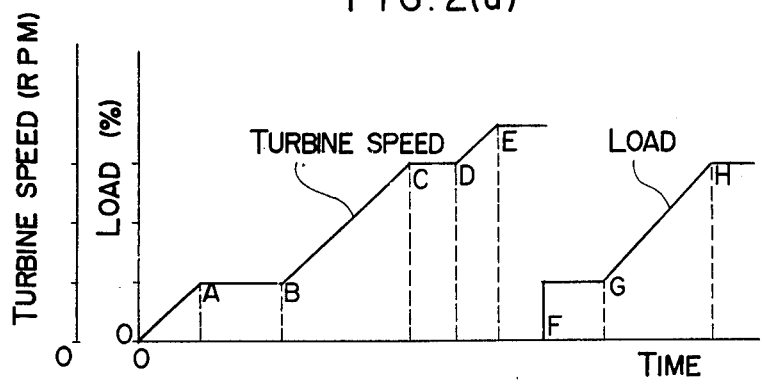
FIGS. 2*a* to 2*c* show the manner in which the main steam temperature, pressure and the thermal stress which is the ultimate question, during acceleration or load-increase of the turbine system of FIG. 1.
Figure 2B:
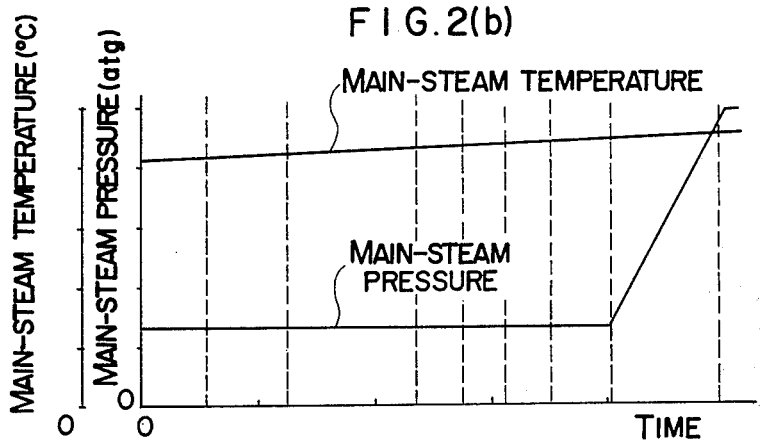
Figure 2C:
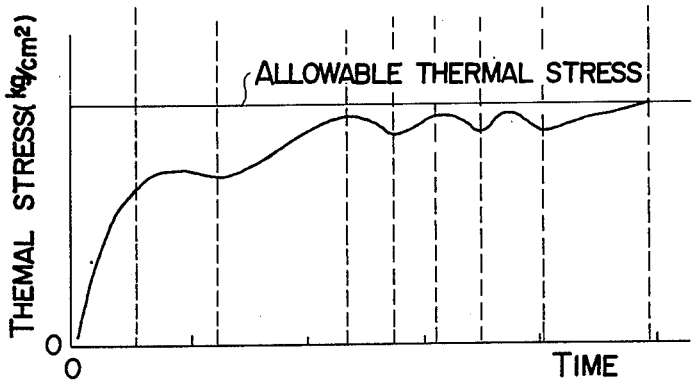

In operating the turbine as described above, it is necessary to control the steam control valves 16 so as to restrain thermal stresses generated in the high-pressure turbine, especially in the portion down stream of the first stage to the level of a predetermined limit. FIGS. 2a to 2c show how the thermal stresses and the steam conditions change during acceleration and load-increase of the turbine. Referring specifically to FIG. 2a which shows changes in turbine speed and load on the turbine in course of time, lines represented by OA, BC and DE correspond to so-called "critical number of revolution" or "critical speed" at which a dangerous resonance takes place on the rotor shaft and which must be passed over quickly to avoid undesirable mechanical effect on the turbine.

As the turbine is accelerated along lines OA, BC and DE of the curve in FIG. 1, the thermal stress changes in the manner as shown in FIG. 2c. Thus, warmingup sections AB and CD are arranged beyond each of the critical ranges of turbine speed to wait for the creeping down of the thermal stress. When the turbine has been speeded up to the rated speed at E of FIG. 1, a breaker 2 (See FIG. 1) is switched on to connect the generator 14 to the electric system 3. After an initial load is applied at the point of time F, it is gradually increased along the line GH, which increase also causes an increase of thermal stress. It will be noted that the tendency of increase in thermal stress due to the increase in load is similar to that resulted by acceleration of the turbine.

FIG. 2b shows temperature and pressure of steam present upstream of the regulating valves 16 (i.e. closer to the boiler) which vary dependent upon the increase in speed and load. These temperature and pressure of steam will be referred to as main-steam temperature and main-steam pressure, respectively. The main-steam pressure is kept constant at least until the turbine speed reaches the point E while the main-steam temperature increases gradually.

The thermal stress generated in the turbine is affected not only by the acceleration rate and rate of load-increase but by the main-steam temperature as well. More specifically, the thermal stress becomes larger as the main-steam temperature increases. Conventionally, means are provided for controlling the mainsteam temperature to keep it constant at a rated temperature, in thermal power plants of this kind. These means, however, becomes operative when temperature has risen close to the rated temperature, and when an initial load has been applied to the turbine.

Therefore, change in the main-steam temperature, as well as the acceleration rate, rate of load increase and the duration of warming time should be taken into account in order to avoid a thermal stress exceeding the predetermined level of limit during acceleration of turbine and change of load.

As will be seen from FIG. 2a, the behaviour of thermal stress generated by the increase in turbine speed and load is similar to each other. Thus, the thermal stress becomes larger as the turbine speed and the load are increased, and is reduced during they are kept constant.

Therefore, the method according to the invention will be described exemplarily with specific reference to the turbine speed. However, the turbine speed and the load thereon can not be treated equally in the exact meaning, since the main steam temperature and pressure tend to change in different manners, as will be seen from FIG. 2. Thus, when the turbine speed is solely used as the index for the control, it will become necessary to compensate for the slight difference between the turbine speed and the load as the factors of the thermal stress. To sum up, the increase of the turbine speed and the increase of the load have common aspects with regard to the thermal stress, so that one can be treated as the representative of the other as far as the thermal stress is concerned, although they are not exactly identical. This is true especially in the case of usual response to the load fluctuation during normal running, for example, in the case of response to an order from ELD, since in such a case the changes in the main-steam temperature and pressure are relatively small. The turbine control can be then performed in a simpler manner.

Hereinafter, an embodiment of the present invention will be described in detail. Referring to FIG. 1, an arithmetic unit according to the present invention is designated at a numeral 100, while a numeral 20 denotes a control unit. The arithmetic unit 100 is adapted to receive signals representative of main-steam temperature $\theta_1$, main-steam pressure P, turbine speed N, main-steam flow rate F and bearing oil temperature $\theta_2$ from respective detectors 250, 251, 252, 253 and 254. The arithmetic unit 100 is capable of calculating the thermal stress $\sigma$ upon receipt of an input signal representative of change in the rate of turbine speed. Although neglected in the illustrated embodiment, warming-up time of the turbine is preferably an input to the arithmetic unit, in addition to the change in the rate of speed, for obtaining an enhanced accuracy for estimating the thermal stress. The arithmetic unit 100 is further adapted to calculate and determine a point of time when speed-up is to be commenced and an acceleration rate of the turbine which will enable starting-up by the expected point of time without causing thermal stresses to exceed the predetermined limit. The resulting speed-up signal 200 is then transmitted to the control unit 20 which in turn controls the steam control valves 16 to allow the acceleration of the turbine at the rate calculated by the arithmetic unit. The arithmetic unit 100 is still further adapted to transmit a signal 202 for controlling the bearing oil temperature to the control unit 20 thereby to control the valve 21.

The said main-steam temperature controller 70 receives input signals representative of the main-steam temperature $\theta_1$ and the temperature $\theta_{1SH}$ of steam downstream of the first superheater 1SH, which signals are transmitted from detectors 250 and 253, respectively. An oil-temperature controller is denoted at a numeral 80. The method of the present invention in which the turbine is speeded up on the basis of these input signals will be described with specific reference to FIGS. 2*a* and 2*b*.

For an easier understanding of the invention, the portions of the curve between A and C, and between C and E in the graph of FIG. 2(*a*) are regarded as respective units of period. In other words, the length of time from the point of time when the turbine has been speeded up to a predetermined first warming-up speed to another point of time when the turbine speed is increased to a second predetermined warming-up speed constitutes one unit of period during acceleration of the turbine. Thus, according to the invention, optimum acceleration rate and length of warming-up time are obtained which will enable completion of starting-up at the schedule time without causing the thermal stress to exceed the predetermined limit. The calculation for determining these two factors is performed soon after the turbine has been speeded up to the first warming-up speed, and the turbine is kept at that speed until the determined warming time elapses. Thereafter, the turbine is allowed to be speeded up at the determined acceleration rate. The acceleration rate is never changed during speeding-up in one unit of period unless it becomes necessary. Thus, briefly, a pattern of speed-up consisting of the acceleration rate of the turbine and the length of warming-up time is determined taking possible thermal stresses into account prior to the commencement of starting-up of the turbine.

Figure 3A:
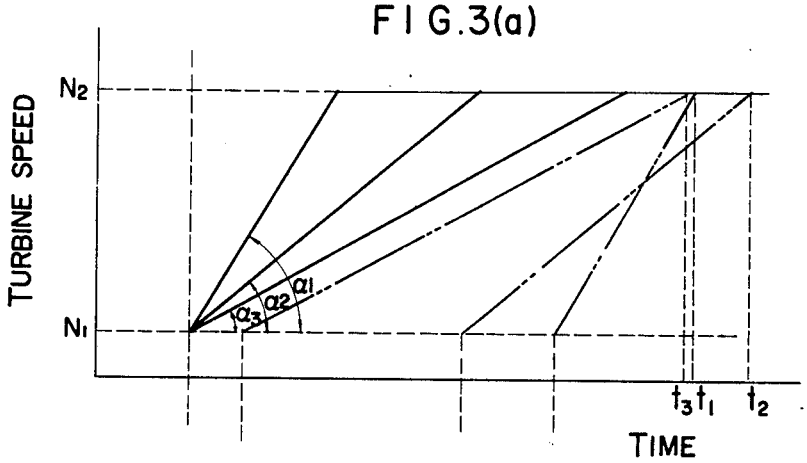
FIGS. 3*a* and 3*b* are graphs for the purpose of for explaining a method of the present invention, and show the manner how the length of warming time and the instant at which the turbine speed reaches a destined speed $N_2$ are determined, for restraining the maximum thermal stress in a rotor to a predetermined limit, when a turbine is to be accelerated from a speed $N_1$ to $N_2$ at a constant rate.
Figure 4A:
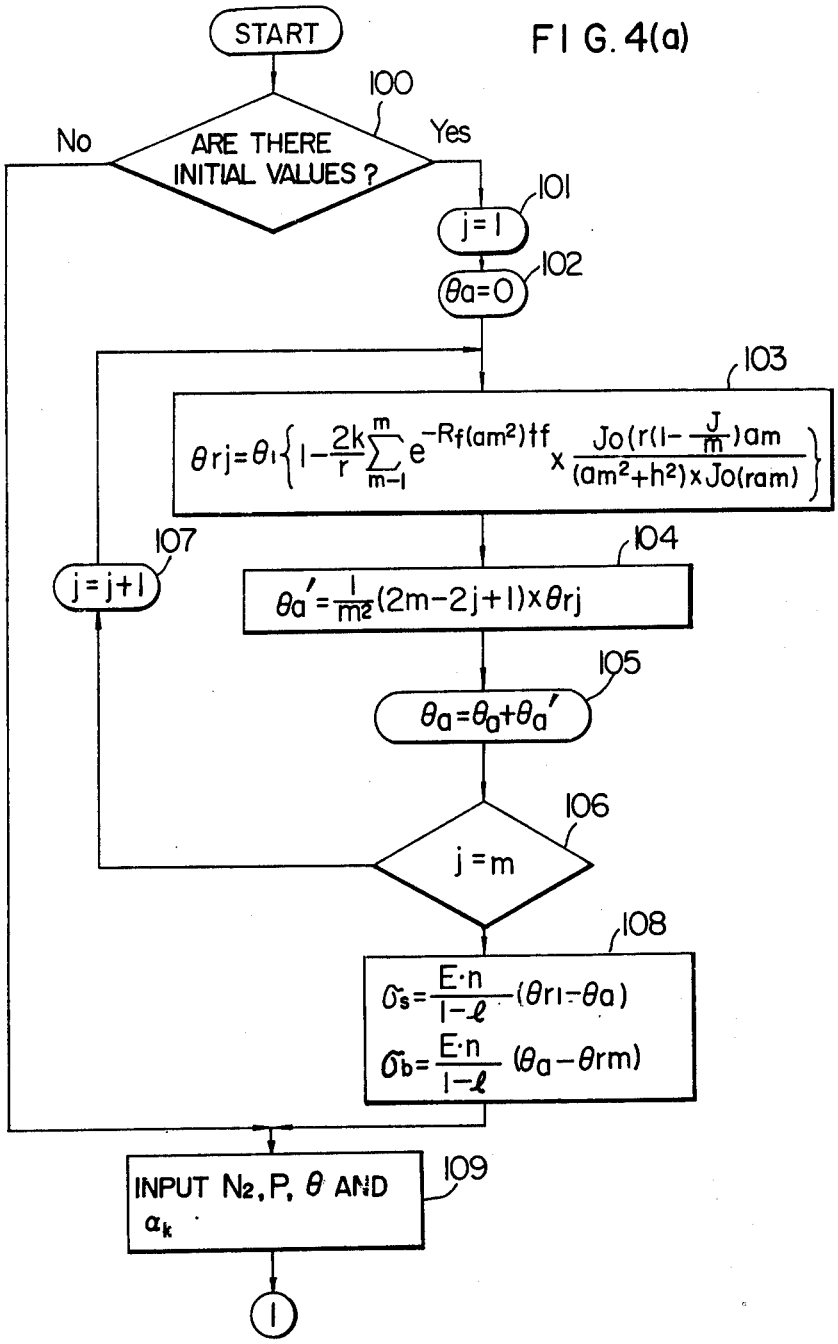
FIGS. 4*a* and 4*b* are programming flow charts in accordance with the present invention for determining the duration of warming and acceleration rate, for increasing the turbine speed up to $N_2$ without causing the resulted maximum thermal stress to exceed the predetermined limit.
Figure 4B:
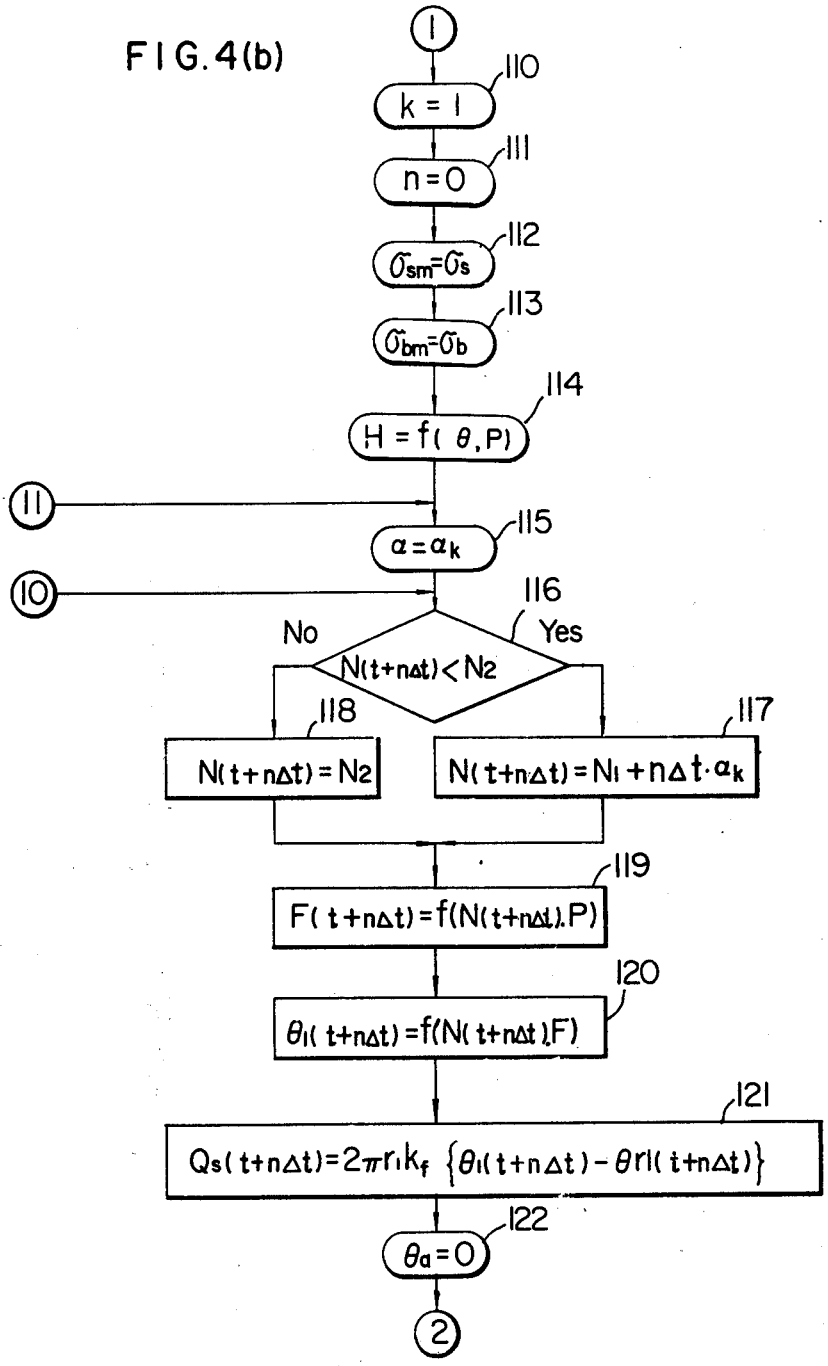
Figure 7:
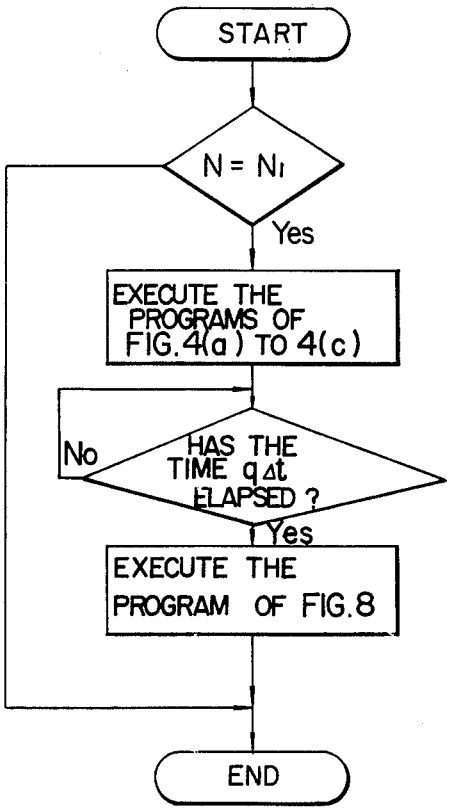
FIG. 7 is a flow chart of a program control for optionally selecting one of the programming flow charts of FIGS. 4a to 4c in accordance with the actual state of acceleration of the turbine, for performing the operation of the present invention.

More specifically, according to the invention, whether the turbine speed N has reached $N_1$ is determined in a process of the flow chart of FIG. 7, and an instruction is issued to start a program of FIG. 4*a* or 4*b* when N has reached $N_1$. FIGS. 4*a* to 4*e* show detailed flow charts for the method of starting-up according to the present invention. It is to be noted that these programs are for the purpose of illustrating the basic idea of the invention, and, therefore, merely show the essential features of the method of the invention in the form of flow charts. These programs are executed when the turbine speed N has reached the predetermined first warming-up speed $N_1$. Since the calculation of thermal stresses is above all required, it is determined at first whether there are initial values of factors or parameters for calculation of thermal stresses. Namely, referring to FIGS. 4*a* and 3*a*, thermal stresses are monitored even before the point of time $t_o$ when the turbine speed reaches $N_1$, and it is determined whether respective parameters are in the known state or in the unknown state. When it is determined that they are in the known state, the program is shifted from the step 100 to the step 109, since it is unnecessary to determine initial values. In the latter case, i.e. when it is determined that they are in unknown state, a parameter $j$ is set at 1 for repetitional operation in the step 101. These repetitional parameters $j$ represent the order of imaginary concentric rings when the turbine rotor is imaginarily divided into m in number of concentric rings in the manner as shown in FIG. 5, and respective concentric rings are numbered 1, 2, 3 .... $j-1, j, j+1$ ... $m-1$ and $m$ from the rotor surface to the rotor bore. Although a method of calculating thermal stresses is specifically mentioned hereinunder, any other known measures may equally be adopted. For example, as is well known, initial values of thermal stresses in the turbine can be known from temperature of metal which forms the turbine wall.

As the first step for calculating an initial value of thermal stress, temperature $\theta_r$ of each of concentric rings of the rotor is found in the following manner.

The initial value of temperature $\theta_r$ is assumed here to be given by the following equation (2) which is a solution to an equation (1) in the form of cylindrical coordinates on the assumption that temperature $\theta_1$ of the rotor surface is kept constant when the initial temperature of the rotor is 0° C.

$$\frac{\alpha\theta_r}{\alpha t} = \frac{\lambda}{c\gamma}\left(\frac{\alpha^2\theta r}{\alpha r^2} + \frac{1}{r}\ \frac{\alpha\theta_r}{\alpha r}\right) \tag{1}$$

$$\theta rj = \theta_1\left\{1 - \frac{2h}{r}\sum_{m-1}^{m} e^{-R}f(am)^2 t_f \times \frac{Jo\left\{r\left(1-\frac{j}{m}\right)am\right\}}{(am^2+h^2)Jo(ram)}\right\} \tag{2}$$

where $r$: radius of the rotor $\lambda$: coefficient of heat-transfer $c$: specific of heat-transfer $\gamma$: specific weight of the rotor material K: coefficient of temperature-transfer $\lambda/c\gamma$ $Kf$: coefficient of temperature-transfer at the rotor surface $m$: the number of the imaginary rings of which the rotor is supposed to consist $\theta_r$: temperature of the rotor $\theta_{rj}$: temperature of the rotor at the portion of $j$-th imaginary ring $h$: $Kf/\lambda$ $t_f$: temperature after $\theta_1$ is settled constant $\beta m$: positive root of an equation of $\beta m J_1(\beta m) - AJo(\beta m)=0$ A : $h_r$... Biot number $\alpha m$ : $\beta m/r$ $J_o$: the zero-th order of the first kind Bessel function $J_1$: the first order of the first kind Bessel function A calculation is executed in the step 103 according to the above equation (2). The parameters used in the operation of the equation (2) are known, as apparent from the above. Thus, the temperature $\theta_{rl}$ of the ring body for $j=1$ is firstly found in step 103.

Subsequently, an average temperature $\theta_a$ throughout the entire volume of the rotor is determined in accordance with the following equation (3). Since the rotor is imaginarily divided into ring portions of equal wall thicknesses, there exists a relationship represented by an equation of:

$$r_j = r_1 - \frac{j}{m} r_1 \tag{3}$$

$$\theta_a = \frac{1}{\Delta l \cdot \pi \cdot r_1^2} \sum_{j=1}^{m} \{\pi r_j^2 - \pi r_{j+1}^2\} \cdot \theta_{rj} \cdot \Delta l = \frac{1}{r_1^2} \sum_{j=1}^{m} \{r_j^2 - r_{j+1}^2\} \cdot \theta_{rj} = \frac{1}{m^2} \sum_{j=1}^{m} (2m - 2j + 1) \cdot \theta_{rj}$$

In the equations, symbol $r_j$ represents an average distance between the center of the rotor and the $j$-th ring portion. An unit axial length of the rotor is represented by $\Delta l$. $\theta_a$ is an average temperature which is obtained by dividing the sum of product of the volume of the respective ring portions and its temperature $\theta_{rj}$ by the entire volume of the rotor. For executing the calculation of the equation (3), $\theta_a'$ is firstly obtained in accordance with the process of FIG. 4a, and is a product of the volume of a ring portion and its temperature when $j$ is specified. The value of $\theta_a'$ calculated at step 104 is added to $\theta_a$ and remembered at $\theta_a$. Since $\theta_a$ is zero in step 102 when $j$ is 1 (one), $\theta_a'$ is remembered at $\theta_a$.

In step 106, it is determined whether $j$ has become equal to $m$. When $j$ is smaller than $m$, $(j+1)$ is used in place of $j$ at step 107 and then the operations of steps 103 to 105 are repeated until $j$ becomes m at step 106.

Thus, when calculation have been executed with respect to the $j$-th ring portion, the sum of the values $\theta_a'$ from the first ring portion to $j$-th one is found at step 105. The average temperature $\theta_a$ throughout the entire volume of the rotor as represented by the equation (3) is obtained with $j$ has reached $m$.

Thermal stresses $\sigma_s$ and $\sigma_b$ at the rotor surface and the rotor bore, respectively, are found making use of the above obtained average temperature $\theta_a$ by the following equations (4) and (5).

$$\sigma_s = \frac{E - \eta}{1 - \gamma} \{\theta_{r1} - \theta_a\} \tag{4}$$

-continued $$\sigma_b = \frac{E \cdot \eta}{1 - \gamma} \{\theta_a - \theta_{rm}\} \tag{5}$$

Since the maximum thermal stress takes place in the rotor surface or in the rotor bore, it is sufficient to calculate only $\sigma_s$ and $\sigma_b$.

In the above equations (4) and (5), $\nu$, E and $\eta$, respectively, represent a poisson's ratio, a Young's modulus and a concentration factor.

When initial valves for calculating thermal stresses exist, or when they have been found by calculations, the process advances to the next step of the operation. At first, a desired warming-up speed $N_2$, main-stream temperature $\theta$ and main-steam pressure P, and a plurality of acceleration rates $\alpha k$ are input to a step 109.

Operations are then executed in accordance with the process of the flow chart of FIG. 4b. At first, parameter $k$ for repeating the operation is entered as k= 1 at step 110, while another parameter n is entered as n = 0 at step 111. Here, k are integers for obtaining a plurality of acceleration rates $\alpha k$, $n$ represents time. Also, $\sigma$ sk and $\sigma$ bk are substituted by $\sigma_s$ and $\sigma_k$, respectively. Namely, initial values $\sigma_s$ and $\sigma_b$ of thermal stresses are stored as $\sigma_{sk}$ and $\sigma_{bk}$, respectively.

At step 114, enthalpy H of main-steam is found as a function of the main-steam temperature $\theta$ and main-steam pressure P. The symbol $f$ represents that enthalpy H is a function of $\theta$ and P. The relationship among H, $\theta$ and P is graphically shown in FIG. 6a, and is well known as steam diagram. The content of this diagram is stored in memory in this program.

Subsequently, as described with repect to FIG. 3a, the turbine speed $N_{(t+n\Delta t)}$ for each elapse of $\Delta t$ starting from the present point of time $t_o$ is calculated. The symbol $\Delta t$ represents a period of time in the order of 1 to 2 minutes. For calculating $N_{(t+n\Delta t)}$, acceleration rate $\alpha k$ when $k$ is 1 is read out at step 115. Then, it is determined at step 116 whether $N_{(t+n\Delta t)}$ has reached a desired speed $N_2$ or not. When $N_{(t+n\Delta t)} < N_2$, the turbine speed $N_{(t+n\Delta t)} = N_1 + n.\Delta t \Delta k$ after an elapse of a time $n\Delta t$ at acceleration rate $\alpha k$ is calculated at step 117, while $N_{(t+n\Delta t)} = N_2$ is input at step 118 when $N_{(t+n\Delta t)} > N_2$. This is to presume the pattern of speed-up as shown in FIG. 3a.

Figures 6A, 6B, 6C:
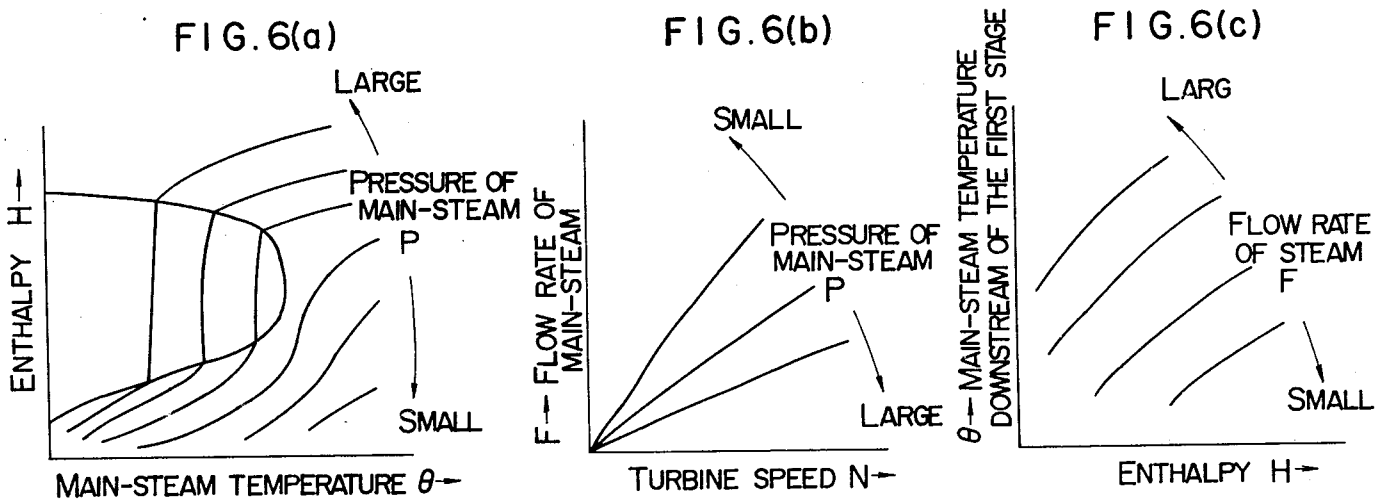
FIGS. 6*a* to 6*c* show characteristics stored for presuming a steam temperature past the first stage of the turbine, for performing the operations of FIGS. 4*a* to 4c, in the system in accordance with the present invention.

Subsequently, a flow rate F of main-steam required to meet the speed $N(t+n\Delta t)$ expected at a moment after an elapse of time $n\Delta t$ is calculated. The flow rate $F(t+n\Delta t)$ at each moment is obtained at step 119 as a function $f(N(t+n\Delta t), P)$ of turbine speed $N(t+n.\Delta t)$ and main-steam pressure P. More specifically, the relationship among F, N and P as shown in FIG. 6b are stored and used to determine the flow rate F.

When the flow rate F is given, the stream temperature $\theta_1$ down stream of the first stage is estimated at step 120. Thus, the temperature $\theta_1$ is found at step 120 from the flow rate F and the enthalpy of the steam at this flow rate in accordance with the formula of $\theta_1(t+n\Delta t) = f(F(t+n\Delta t), H)$. The determination of the temperature $\theta_1$ is performed also by the stored relationship as shown in FIG. 6c.

Then the thermal stresses in the turbine at each expected moment, on the assumption that the turbine speed is increased at a constant rate $\alpha$ as shown in FIG. 3a, are calculated as follows. To this end, according to the method of the invention described in this specification, the thermal stresses are calculated from a temperature distribution of the rotor obtained by a calculation in accordance with a dynamic-characteristic equation which is provided by a concentration system of temperature characteristics of rotor portions, $m$ portions are assumed, for example, by deviding the rotor in the radial direction in the manner as shown in FIG. 5. At first, the amount of heat $QS(t+n\Delta t)$ transferred from the steam downstream of the first stage to the outermost ring portion (i.e. the portion of $j=1$) and the amount of heat $Q_{j,j+1}(t+n\Delta t)$ transferred from the $j$-th ring portion to the $j+1$-th ring portion are obtained from the following equations, respectively.

$$Q_s(t+n\Delta t) = 2\pi r_1 k_j\{\theta_1(t+n\Delta t) - \theta_{r2}(t+n\Delta t)\} \ldots \quad (6)$$

$$Q_{j,j+1(t+n\Delta t)} = 2\pi r_j \frac{m\lambda}{\alpha}\{\theta_{rj}(t+n\Delta t) - Q_r \cdot J+1(t+n\Delta t)\} \quad (7)$$

As the heat is transferred in this manner, the heat Qj possessed by the $j$-th ring portion is represented as the differential between the heat input thereto and the heat discharged therefrom, i.e. from te following equation (8).

$$Q_{j(t+n\Delta t)} = Q_{j-1,j(t+n\Delta t)} - Q_{j,j+1(t+n\Delta t)} = \frac{MC}{(1-\frac{(j-1)}{m})^2-(1-\frac{j}{m})^2} \times \frac{\Delta\theta_{rj(t+n\Delta t)}}{\Delta t} \quad (8)$$

In the equation (8) above, symbols M and $d$ denote, respectively, the mass of the rotor material and the radial thickness of the ring portions, i.e. $r/m$. The symbol $\Delta\theta_{rj}$ represents the variation of the temperature $\theta_r$ in the $j$-th ring portion in the unit time $\Delta t$. The equation (8) can be transformed into the following equation (9) to provide the $\theta_{rj(t+n\Delta t)}$.

$$\Delta\theta_{rj(t+n\Delta t)} = \Delta t\{Q_{j-1,j(t+n\Delta t)} - Q_{j,j+1(t+n\Delta t)}\} \times \frac{(1-\frac{(j-1)}{m})^2-(1-\frac{j}{m})^2}{MC} \quad (9)$$

It will be understood that the answer or solution of the equation (7) provides the $\Delta\theta_{rj}$. In the equation (9) above, when $j$ is 1, the term $Q_{j-1,j}$ representing the heat transmitted to the ring portion can be substituted by $Q_s$, so that the equation (9) can be transformed into the following equation (10).

$$\Delta\theta_{r1(t+n\Delta t)} = \Delta t\{Q_{s(t+n\Delta t)} - Q_{1,2(t+n\Delta t)}\} \times \frac{1-(1-\frac{1}{m})^2}{MC} \quad (10)$$

At the same time, the term $Q_{j,j+1(t+n\Delta t)}$ represents the heat transmitted to the rotor bore, when $j$ is $m$, from the $m$-th ring portion. The amount of this heat transfer to the rotor bore from the $m$-th ring portion can be neglected, although this amount of heat cannot be derived from the equation (7), since it is considered that there is no heat transfer materially taking place from the ring portion $m$ to the rotor bore. Thus, the following equation (11) is derived from the equation (9).

$$\Delta\theta_{rm(t+n\Delta t)} = \Delta t \cdot Q_{m-1,m(t+n\Delta t)} \times \frac{(1-\frac{m-1}{m})^2}{MC} \quad (11)$$

The temperature distribution in the rotor is derived from this value of $\Delta\theta_{rj}$.

$$\theta_{rj(t+n\Delta t)} = \Delta\theta_{rj} + \theta_{rj}(t+(n-1)\Delta t) \ldots \quad (12)$$

Figure 4C:
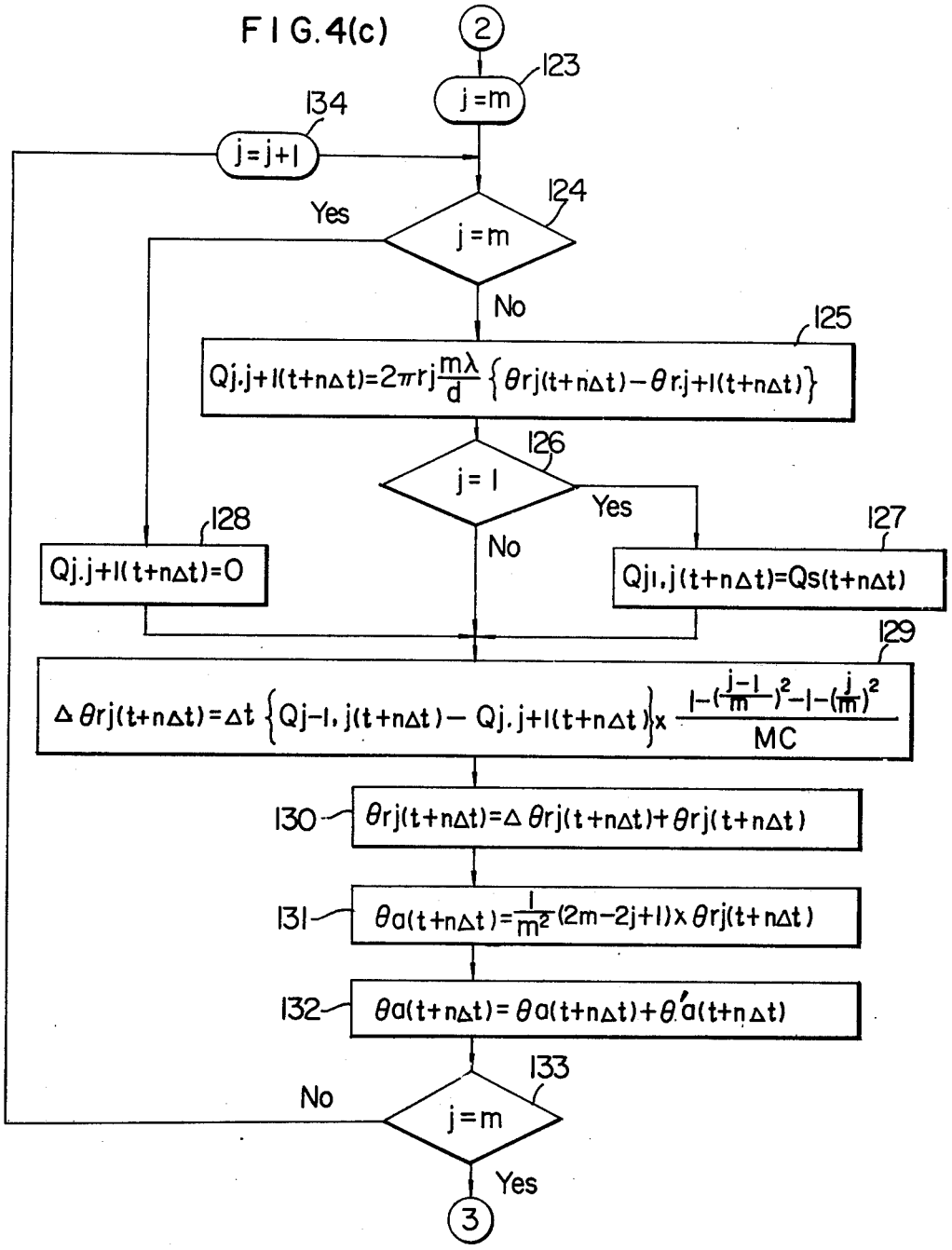
Figure 4E:
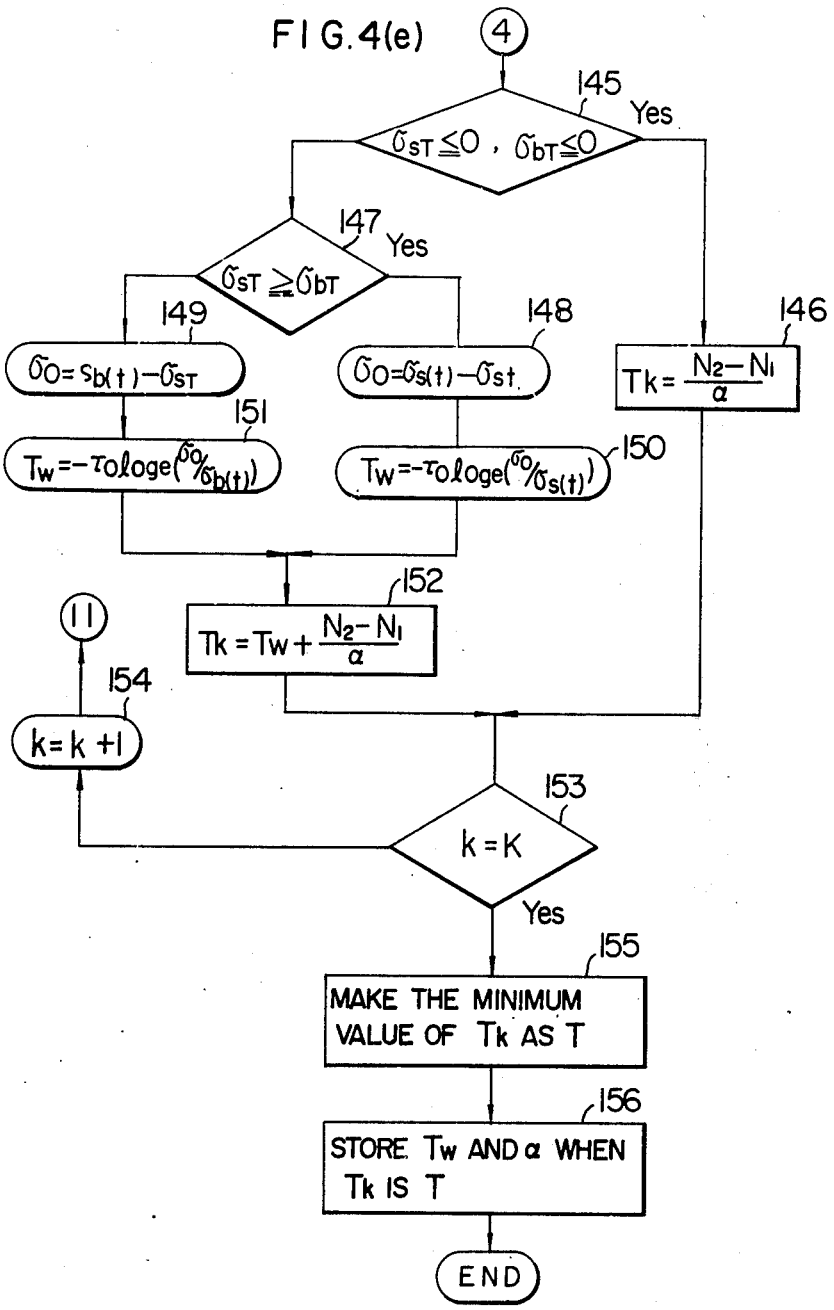

The thermal stresses at the rotor surface and the rotor bore are obtained from above obtained $\theta_{rj(t+n\Delta t)}$, through calculations of said equations (3), (4) and (5), in the manner as detailed below with reference to the flow charts of FIGS. 4b and 4c.

At first, the calculation of the said equation (6) is performed in step 121 of the flow chart of FIG. 4b, to provide $Q_s(t+n\Delta t)$. Subsequently, in step 123 of FIG. 4c, calculations of steps 124 to 134 are repeated, putting at first the parameter $j$ for obtaining the thermal stress at 1, until step 133 determines whether the parameter $j$ has reached $m$. For obtaining the average temperature $\theta_a$ per rotor volume, as is the case of step 102, $\theta_a$ is made 0 in step 122.

The step 133 performs determining whether $j$ equals $m$ or not. When $j$ is determined not to equal $m$, the calculation of the equation (7) is performed in step 125 to provide $Q_{j,j+1(t+n\Delta t)}$. It is to be noted that the datum $\theta_{rj}$ used in steps 121, 125 and 130 is that when $n$ is zero and $j$ is one. The datum prepared at step 103 is used when no initial value is available at the time of starting of this program. Subsequently, step 126 performs determining whether the $j$ is 1 or not. The calculation of the equation (9) is performed at step 129, in accordance with the value of the $j$. Namely, when the $j$ is determined to be 1 (i.e. when the output from step 126 is "yes"), step 129 performs the calculation of the equation (9), with the term $Q_{j-1,j(t+\Delta nt)}$ being substituted by $Q_s(t+n\Delta t)$ in step 127. When the $j$ is $m$, i.e. when the output from step 124 is "yes", the term $Q_{j,j+1(t+n\Delta t)}$ of the equation (9) is substituted by 0 for the subsequent operation by step 129. The above calculations performed in step 129 correspond, respectively, to the calculations of aforementioned equations (10) and (11). Operation of step 129 is performed without any substitution when it is determined to be $2 \leqq j \leqq m-1$, i.e. when the output from step 126 is "no".

Subsequently, the calculation of the equation (12) is performed in step 130 to provide $\theta_{rj(t+n\Delta t)}$. This means that the sum of the previously remembered $\theta_{rj}$ and $\Delta\theta_{rj}$ obtained in step 129 is newly stored.

Steps 131 and 132 are calculating the average temperature $\theta_a$ per volume of the rotor as represented by the equation (3), and correspond to the said steps 104 and 105, respectively.

As will be seen from the foregoing description, operations of these steps are repeated for altered $j$ until $j$ becomes equal to $m$, thereby to provide the value of $\theta_a$ which satisfies the equation (3). Since this manner of repetition of operations have been described already, the detailed description thereof is neglected here. The operations of steps 124 to 133 are repeated until "$j=m$" is determined in step 133, and provide $\theta_a$.

Then, step 135 performs the calculations of the equations (4) and (5), as is the case of step 108, to provide the thermal stresses $\sigma_s$ and $\sigma_b$ at the rotor surface and the rotor bore, respectively. The thermal stress changes along the upwardly convexed curve of FIG. 3b, as the turbine speed is increased to the destined speed $N_2$ in the manner shown in FIG. 3a. The maximum thermal stresses $\sigma_{sm}$ and $\sigma_{bm}$ are obtained from the thermal stresses determined by step 135.

At first, $\sigma_{sm}$ is compared with $\sigma_{s(t+n\Delta t)}$ in step 136. When $n$ is 0, $\sigma_{sm}$ is made equal to $\sigma_s$ in step 112. $\sigma_s$ is the initial value of the thermal stress obtained in step 108.

Figure 3B:
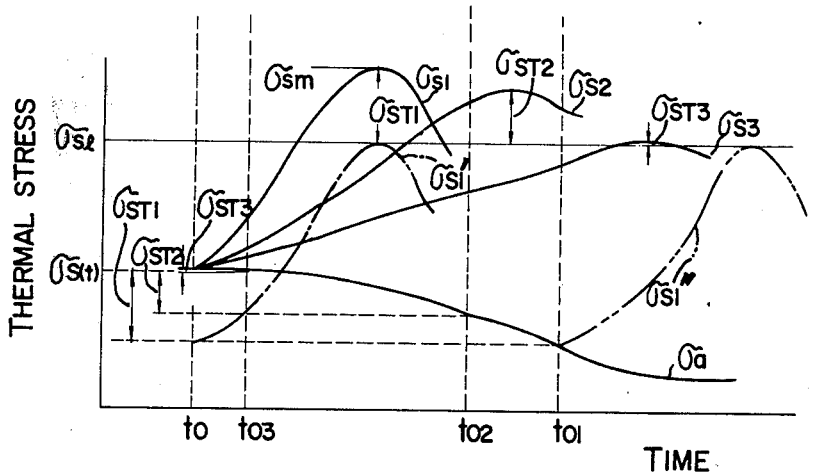

When $\sigma_{sm}$ is determined to be larger than $\sigma_s$, step 137 inputs $\sigma_{sm} = \sigma_{sm}$ to step 139, while step 138 inputs $\sigma_{sm} = \sigma_{s(t+n\Delta t)}$ to step 139. Since the thermal stress is usually inclined to increase in the course of acceleration as shown in FIG. 3*b*, the thermal stress $\sigma_{s\,(t+n\Delta t)}$ is larger than $\sigma_{sm}$. Therefore, in the course of acceleration of value of $\sigma$sm is changed to the newly calculated $\sigma$s $(t+n\Delta t)$ at each elapse of time of $\Delta t$.

After the turbine speed has reached the destined speed $N_2$, since the thermal stress segins to decrease, $\sigma$sm becomes smaller than $\sigma$s (t+nΔt), so that step 137 puts $\sigma$sm = $\sigma$sm. Consequently, the maximum value of the thermal stress $\sigma$s when the turbine speed is increased as shown in FIG. 3*a* is calculated and stored in steps 136, 137 and 138. Calculations similar to those of steps 136, 137 and 138 are performed also for the thermal stress $\sigma b$ of the rotor bore, in steps 139, 140 and 141. The completion of the operation of step 140 means that the thermal stress $\sigma b$ which had increased in accordance with the increase of the turbine speed has begun to decrease as warming is commenced and the maximum value $\sigma$bm has been stored. The determination of a state of $\sigma$sm > $\sigma$s(t+nΔt) in step 142 means that both have changed along upwardly convexed curves and their maximum values $\sigma_{sm}$, $\sigma_{bm}$ have been stored. The calculation is returned to step 116, as step 143 puts $n = n+1$, to repeat the operation of steps 116 to 141, until the maximum values of the thermal stresses $\sigma_s$ and $\sigma_b$ are obtained.

After these maximum values of the thermal stresses have been obtained, the time T*k* until the turbine speed reaches the destined speed $N_2$ is determined. This time T*k* is the sum of the warming time T*w* and the time required for the speed-up. For obtaining the time T*k*, the terminal stresses expected to be caused by the speed increase up to the second warming speed $N_2$ have been presumed through the operations up to step 143, at the point of time $t_o$ when the turbine speed has reached the first warming speed $N_1$. The relationship between the turbine speed and the thermal stress is as shown in FIGS. 3*a* and 3*b*. FIG. 3*b* exemplarily shows the thermal stress $\sigma$s at the rotor surface. In FIG. 3*b*, the thermal stresses resulted by the acceleration rates $\alpha_1$, $\alpha_2$ and $\alpha_3$ of the turbine are denoted by $\sigma_{sl}$, $\sigma_{s2}$ and $\sigma_{s3}$, respectively. It will be seen that the maximum value $\sigma_{sm}$ of the stress $\sigma$s gets larger, as the acceleration rate $\alpha$ gets large. Needless to say, as well be seen from FIG. 3*a*, $\alpha_2$ is assumed to be larger than $\alpha_3$, but smaller than $\alpha_1$.

Supposing here that the turbine speed is increased at a constant rate $\alpha$, there occurs a change in the thermal stress represented by $(\sigma_{sm} - \sigma_{s(t)})$ during acceleration from $N_1$ to $N_2$, representing the thermal stress at the instant $t_o$ at which acceleration is commenced and the maximum value of the thermal stress $\sigma$s by $\sigma$s (*t*) and $\sigma$sm, respectively. This change $(\sigma_{sm} - \sigma_{s(t)})$ is considered almost constant when the acceleration rate is constant. Therefore, in order to restrain the maximum stress $\sigma$sm within the limit $\sigma$sl, acceleration is preferably commenced at an instant when the thermal stress $\sigma_o$ is represented by the equation of: $\sigma_o = \sigma$s(t) − ($\sigma$sm − $\sigma$sl) = $\sigma$s(t) − $\sigma$sT, where $\sigma$sT is the difference between the limit $\sigma sl$ and the maximum valve $\sigma$sm of the thermal stress. To explain $\sigma$sl, for example, if acceleration is commenced at an instant when the thermal stress is ($\sigma$s(t) − $\sigma$sTl), the stress $\sigma$sl becomes $\sigma$sl′ and does never exceed the limit $\sigma$sl.

As warming is commenced and continued from the point of time $t_o$, the thermal stress gradually decreases as shown by the curve $\sigma$a. Then a point of time $t_{ol}$ when a relationship of $\sigma$s(t) − $\sigma$s$T_1$ = $\sigma$a is established is obtained. When the turbine speed is increased from the point of time $t_{ol}$ at a rate $\alpha_1$, the thermal stress $\sigma sl$ varies in accordance with the curve $\sigma$sl′ and does never exceed the limit $\sigma sl$. Thus, the time T*wl* required for warming is represented by $(t_{ol} - t_1)$. At the same time, the time Tal required for increasing the turbine speed to $N_2$ is represented by $(N_2 - N_1/\alpha_1)$. Thus, the total time $T_1$ is given by the following equation of: $T_1$ = T*wl* − T*al* = $t_{ol} - t_o + N_2 - N_1/\alpha_1$. The point of time when acceleration is completed is denoted at $t_1$, for the acceleration rate $\alpha_1$.

In the present invention, the time T*k* required for increasing the turbine speed to $N_2$ with a constant rate $\alpha$k is obtained. However, as thermal stresses $\sigma$s and $\sigma b$ are generated on the rotor surface and on the rotor bore and the limit values $\sigma sl$ and $\sigma bl$ are set with respect to thermal stresses $\sigma sl$ and $\sigma bl$, more serious one of the thermal stresses is selected in the following program to determine the time T*k*.

In step 144 of FIG. 4*d*, the difference between the maximum value and the limit value is obtained for each of the thermal stresses $\sigma s$ and $\sigma b$. The differences or deviations are represented by $\sigma_{s\,T}$ and $\sigma$bT, respectively. Subsequently, it is determined whether the both of $\sigma$sT and $\sigma$b are simultaneously negative. When both of these deviations are negative, the maximum thermal stress does not exceed the limit value, even when acceleration is commenced with an acceleration rate $\alpha$ at the point of time $t_o$ when the turbine speed has reached the first warming speed $N_1$. Since acceleration is commenced at the point of time $t_o$, in this case, the time T required for increasing the speed to $N_2$ is given by T = $N_2 - N_1/\alpha$. This calculation is performed in step 146.

To the contrary, when one of $\sigma$sT and $\sigma$bT is determined to be positive, $\sigma$sT and $\sigma$bT are compared with each other in step 147. When $\sigma$sT is determined as being larger than $\sigma bT$, the difference between the value $\sigma s(t)$ of $\sigma s$ at the point of time $t_o$ and $\sigma$sT is obtained. This difference is represented by $\sigma_o$.

An assumption is made here that the thermal stress decreases as a logarithmic function as warming is continued from the point of time $t_o$. Subsequently, the length of time required for the thermal stress $\sigma$s to decrease from $\sigma$s(t) to $\sigma_o = \sigma$s(t) − $\sigma$sT is obtained in steps 150 and 151. The length of time thus obtained represents the minimum warming time Tw which is necessary for restraining the maximum thermal stress $\sigma sk$ to the limit $\sigma sl$ when the turbine speed is to be increased at the rate $\alpha$.

The minimum warming time is obtained from the following equations (13) and (14). T*w* = − $\tau$o loge ($\sigma$o/$\sigma s(t)$) (13)

$$Tw = -\sigma o \log_e (\sigma o/\sigma\, b(t)) \quad (14)$$

The symbol $\tau$o represents a constant provided in accordance with the characteristic of the turbine.

Subsequently, the time Tk required for increasing the turbine speed to $N_2$ is obtained from the following equation (15).

$$Tk = Tw + N_2 - N_1/\alpha \quad (15)$$

The completion of the program up to this step means that the warming time T*w* has been determined for a rate $\alpha k$ at which the turbine speed is to be increased.

Step 153 performs determining whether the parameter $k$ for selecting the acceleration rate equals a predetermined number K. When the parameter $k$ is determined as being smaller than K, the program is returned to step 115 with an input of $k = k + 1$. The warming time T$w$ is obtained in the manner similar to the case when $\alpha = \alpha k$. Thus, the warming times T$w$ are obtained in sequence in the same manner for the successive acceleration rates $\alpha_1, \alpha_2, \ldots \alpha k$.

As have been described in connection with FIGS. 3*a* and 3*b*, the point of time when acceleration is allowed to start is $t_{ol}$ for the acceleration rate $\alpha_1$. Corresponding points of time $t_{o2}$ and $t_{o3}$ are supposed to have been obtained from the programs of FIGS. 4*a* and 4*c* for the acceleration rates $\alpha_2$ and $\alpha_3$. Since the maximum thermal stress becomes small as the acceleration rate $\alpha$ gets small, a relationship in general exists which is represented by $t_{ol}<t_{o2}<t_{o3}$. Representing the moments at which the turbine speed reaches $N_2$ by $t_1$, $t_2$ and $t_3$, when acceleration is commenced at respective points of time with respective acceleration rates, the relationship of $t_1<t_2<t_3$ does not always exist. Rather, in the example as shown in FIG. 3, there exists a relationship represented by $t_3<t_1<t_2$. Thus, it is derived that the most quick acceleration from $N_1$ to $N_2$ without causing the thermal stress to exceed the predetermined limit is obtained by continuing the warming to the point of time $t_{o3}$ and then increasing the turbine speed at the rate $\alpha_3$. Referring to the program of FIG. 4*e*, the shortest one within which the destined speed $N_2$ is reached is selected from a plurality of times T$k$ in step 155. The warming time T$w$ and the acceleration rate $\alpha$ for the minimum time T are stored in step 156. When the operation of step 156 is completed to store the warming time T$w$ and the acceleration rate $\alpha$, this program is completed. The operations of the programs of FIGS. 4*a* to 4*e* are accomplished within a predetermined time from the point of time $t_o$ when the turbine speed N reaches the first warming speed $N_1$. This predetermined length of time is a multiple of time described in connection with the calculation of the speed $N(t+n\Delta t)$ and other factors in the course of the programs of FIGS. 4*a* to 4*e*. This length of time is represented by $q\Delta t$.

Turning again to FIG. 7, as the programs of FIG. 4*a* to FIG. 4*e* are completed, it is determined whether the time $q\Delta t$ has elapsed since the turbine speed had reached $N_1$. The program does not advances until the time $q\Delta t$ elapses. As the elapse of the time $q\Delta t$ is confirmed, the programs of FIGS. 8*a* and 8*b* are started.

Figure 8A:
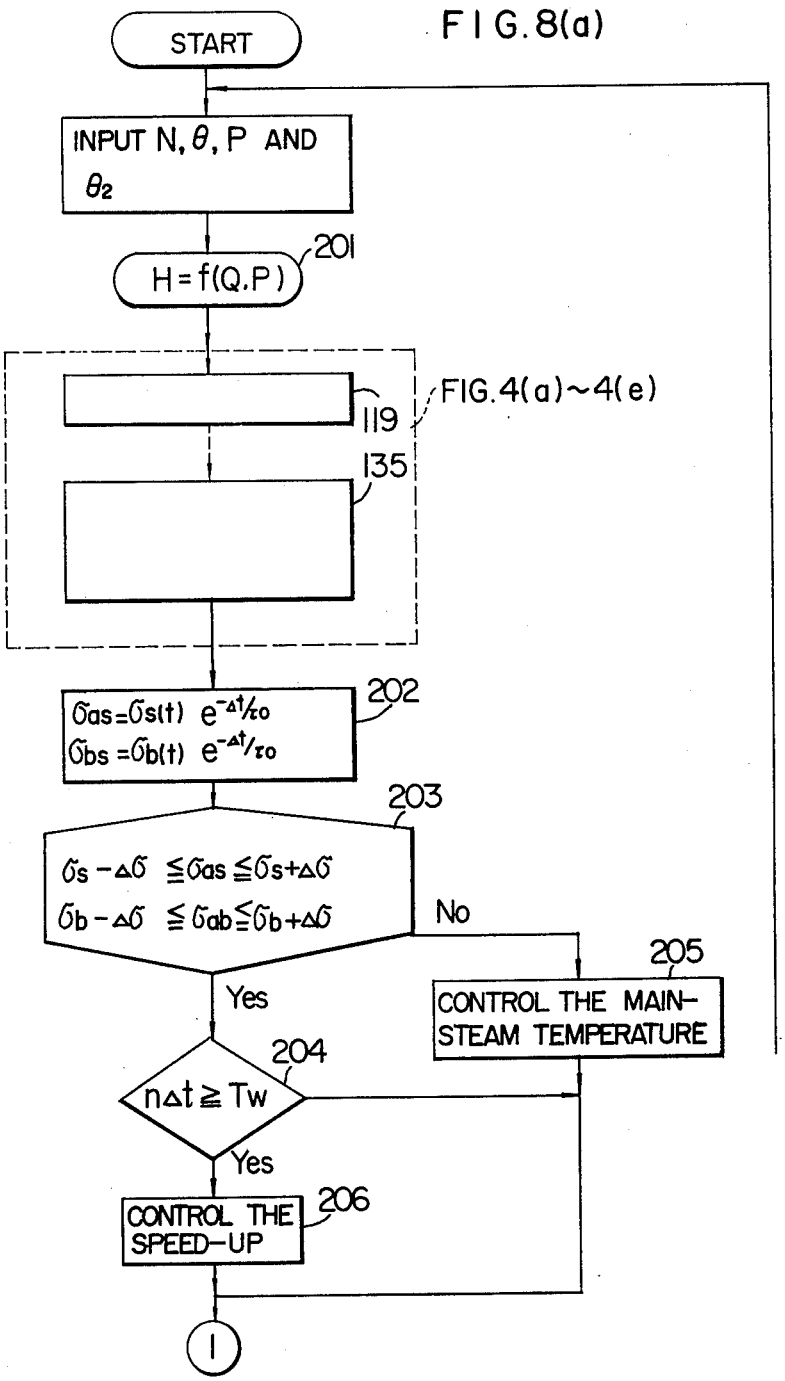
FIGS. 8a and 8b are programming flow charts for observing the thermal stress and bearing-oil temperature at the time of starting and for controlling as required the main steam temperature and the bearing-oil temperature.
Figure 8B:
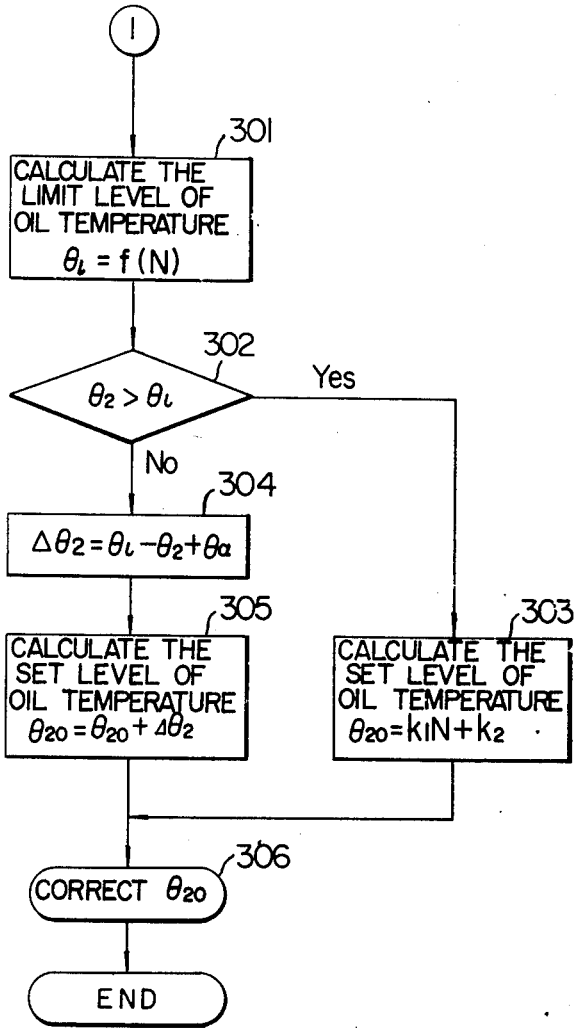

These programs of FIGS. 8*a* and 8*b* can be said to be programs for observing whether the turbine speed can increase in accordance with the presumed pattern, while the said programs of FIG. 4*a* to FIG. 4*e* are those for presuming the pattern of acceleration consisting of the duration of warming and the acceleration rate. In the programs of FIGS. 8*a* and 8*b*, the thermal stress and bearing oil temperature are observed, and the main-steam temperature as well as bearing oil inlet temperature is controlled, if necessary, for allowing the starting up of the turbine in accordance with the pattern presumed by the programs of FIGS. 4*a* to 4*e*.

At first, the actual thermal stress is obtained at the point of time $q\Delta t$. Since this actual thermal stress can be obtained in a manner similar to the programs of FIGS. 4*a* to 4*e*, parts of these programs are used for the calculation of the actual thermal stress. Since it is not possible to use all of these programs, calculations of steps 200 and 201 are previously performed. At first, the turbine speed N, main-steam temperature $\theta$ and main-stream pressure P at this point of time are incorporated as inputs. Subsequently, enthalpy H is obtained in the manner similar to step 114 of FIG. 4*b*. The thermal stresses $\sigma$s and $\sigma$b at the point of time $n\cdot\Delta t$ are obtained through the operation of steps 119 in FIG. 4*b* to 135 of FIG. 4*e*. When the data at the point of time when $\Delta t$ exists before the instant $q\Delta t$, for performing the operations concerning the point of time q$\Delta$t in steps 119 to 135, the data at the point of time $(q-1)$ as used in the calculations of FIGS. 4*a* to 4*e* are used.

As aforementioned, the thermal stress $\sigma$a during warming is decreased as time elapses, as will be seen from FIG. 3*b*. The behaviour of the decreasing thermal stress is represented in the calculations of FIGS. 4*a* to 4*e* by logarithmic functions, i.e. by the equations (13) and (14). Then, thermal stresses $\sigma$as and $\sigma$ab are obtained from these equations for the purpose of comparison with the above obtained actual thermal stresses $\sigma$s and $\sigma$b. It will be understood that acceleration of the turbine in accordance with the presumed program can be continued only when the calculated thermal stresses $\sigma as$, $\sigma ab$ and the actual thermal stresses $\sigma s$, $\sigma b$ are almost equal to one other. Thus, step 202 is for calculating the thermal stresses $\sigma as$, $\sigma ab$ which are expected for good advancement of the program, while the comparison of these calculated stresses with the actual thermal stresses $\sigma s$, $\sigma b$ is performed in step 203 to determine whether the differences therebetween fall within a predetermined allowable range. Since the differences or diviations beyond the predetermined allowable range is attributable to the fluctuation of thermal stress caused by the fluctuation of main-steam temperature, step 205 provides a control of this temperature in accordance with the values of $\sigma s$, $\sigma b$ in a manner to be detailed later.

When the actual stresses $\sigma s$, $\sigma b$ are found to be within the allowable range, the next step 204 provides a determination as to whether the presumed warming time has elapsed. Step 206 functions to commence acceleration as step 204 confirms the elapse of the warming time, i.e. the conditions of $n\cdot\Delta t>$T$w$. When it is determined in step 203 that the main-steam temperature control is necessary, or when it is determined in step 204 that the warming time has not elapsed, the program is advanced to step 207. According to the program for observing the thermal stress and for controlling the main-steam temperature as described above, acceleration cannot be allowed until the differences between the expected and actual thermal stresses, i.e. the differences between $\sigma as$, $\sigma ab$ and $\sigma s$, $\sigma b$, come within a predetermined range, even when the warming time has elapsed. However, it does not actually take place that the thermal stresses abruptly get out of the allowable range of deviation when the time has come up close to the expected time for acceleration. Rather, it is considered that the main-steam temperature control is commenced well in advance to that time. Therefore, it can hardly occur that the commencement of acceleration largely delays behind the expected time.

The manner of the main-steam temperature control as described in connection with step 205 will be described hereinafter. This control is performed by a part of an unit called "Automatic Boiler Controller". The automatic boiler controller is well known as an apparatus for optimizing the conditions of boiler such as main-steam temperature and pressure by controlling factors such as fuel and feed water supplies. Control of the main-steam temperature is accomplished mainly by controlling the fuel supply. Therefore, the following description as to the main-steam temperature control is directed to control means for the fuel supply, especially for the fuel supply during the period of acceleration.

Figure 9:
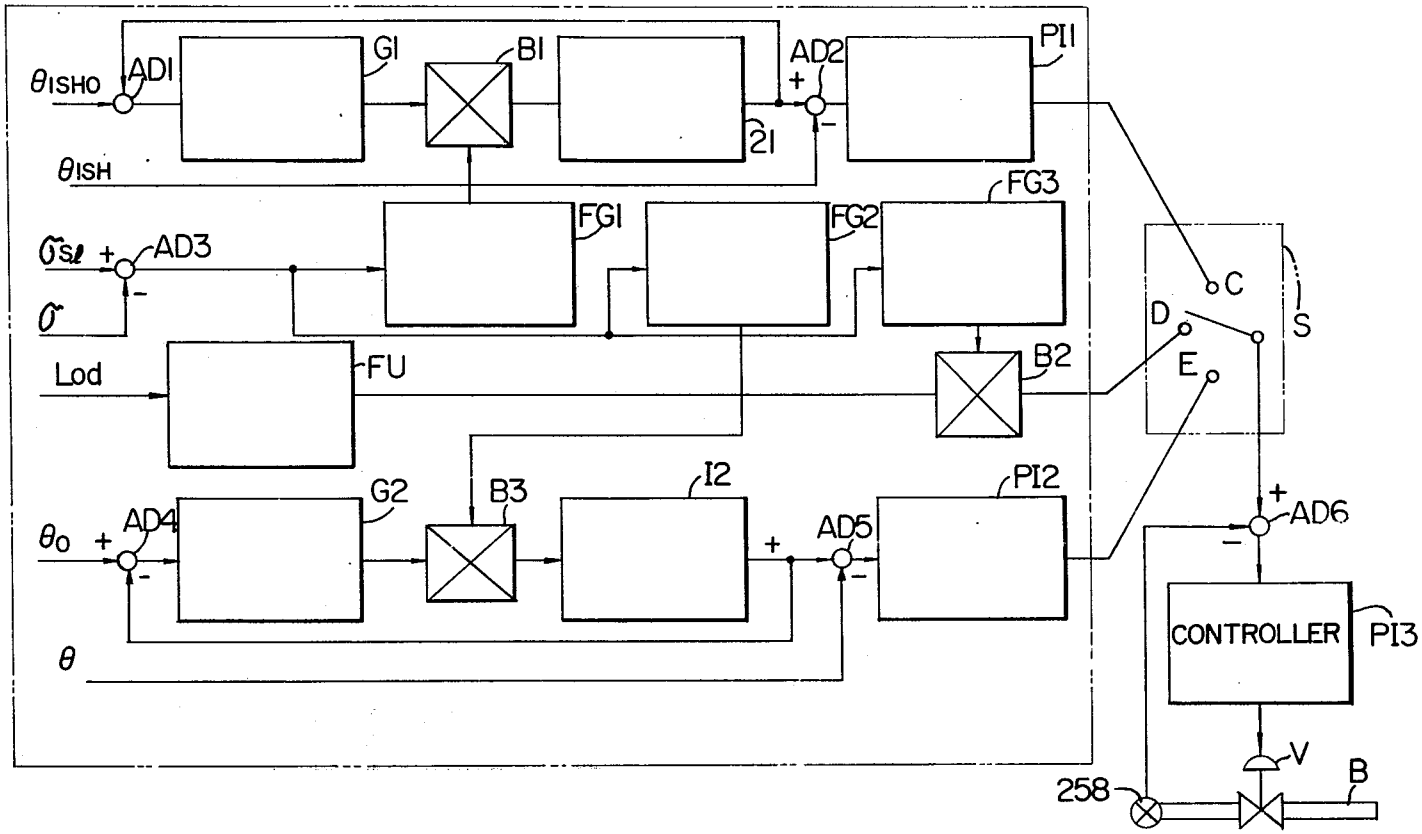
FIG. 9 shows an example of a system adapted for controlling the fuel supply to a boiler in accordance with the thermal stress.

Referring to FIG. 9 which shows a general arrangement of this controller, a burner and a fuel regulating valve are denoted by symbols B and V, respectively. The opening degree of the regulating valve V is adapted to be controlled by a controller PI3. An adder AD6 is adapted to output a difference between the fuel demand and the output from a fuel transmitter 258 to the controller PI3 through a switch S. The fuel demand is determined by a controller enclosed by the dot-and-chain line. A controller for the primary superheater outlet steam temperature $\theta_{1SH}$ (the primary superheater will be referred to as "PSH", hereinafter) is connected to a contact C, while an initial load (Lo) controller and a main-steam temperature controller are connected to contacts D and E of the switch S, respectively.

The selection of these three controllers is preserved because the steam condition is not always stable during acceleration of the turbine.

More specifically, the flow rate of the main-steam is extremely small, before the turbine is steamed by the main-steam, so that the main-steam temperature cannot be detected without any substantial error. To compensate for this, the boiler is started relying upon the PSH outlet temperature controlling system C. As a sufficient flow rate of the main-steam is established, after the steaming through the turbine, the fuel control system is switched to be ruled by the main-steam temperature controlling system E. The short period between the modes of systems C and E, i.e. the period mentioned in connection with FIG. 2 from the time of putting the alternator into the circuit to the time of completion of holding the initial load, is upheld by the control system D. Thus, the main-steam temperature control system becomes effective after the completion of holding of the initial load.

In the control system of the described type, the rate of change in the main-steam temperature is selected irrespective of the speed or load increase, nor of the speed or load holding. Therefore, an increase of the thermal stress sometimes takes place even during the speed or load is unchanged when the flow rate of the main-steam temperature (or the fuel demand for the initial load) is excessively large.

Referring to FIG. 9, adders AD are provided for performing operations for obtaining deviations. Symbols PI, L and I denote, respectively, a proportional integration controllers, limiters and integrators, while $\theta_{1SHO}$ and $\theta_o$ respectively denote set values or commands for the temperatures $\theta_{1SH}$ and $\theta$, respectively. An initial load demand signal is represented by Lod. Symbols $FG_1$ to $FG_3$ and $B_1$ to $B_3$ respectively denote function generators which constitute a characteristic feature of the present invention and compensators.

Referring at first to the system for controlling the temperature $\theta_{1SH}$, the command $\theta_{1SHO}$ is input through the adder AD1, the limiter $L_1$, the compensator $B_1$ and the integrator $I_1$. A signal which increases as the time elapses until $\theta_{1SH}$ comes to equal $\theta_{1SHO}$ is obtained at the integrator $I_1$. The differential between this signal and $\theta_{1SH}$ is obtained at the adder $AD_2$, and is input to the terminal C through the controller $PI_1$. The circuit for controlling the temperature $\theta$ is constituted by an almost similar manner.

Referring now to the system for controlling the initial load control signal Lod, a fuel supply rate corresponding to the outputting of a given signal Lod is obtained at the setter FU.

It is to be noted that the function generators $FG_1$ to $FG_3$ perform compensations of changing rates of steam temperature at the outlet of the superheater PSH, fuel demand corresponding to the initial load and of the main-steam temperature, in accordance with the deviation of the estimated thermal stress (or maximum presumed thermal stress) from the limit of the thermal stress. According to a characteristic aspect of the invention, the compensations is not effected when the deviation assumes a positive value larger than a predetermined value. The changing rates are made smaller as the deviation falls within the range of the predetermined value and are made (zero) when the deviation assumes a negative value. In case of the compensation of the fuel supply demand, the rate of fuel supply is gradually decreased following a hyperbola whose asymptote represents the minimum fuel supply, or partial-proportionally, when the deviation comes down lower than the predetermined positive value, as shown in the block 352.

The main-steam temperature is controlled in the manner as described above.

Turning again to FIG. 8*a*, the control of acceleration of the turbine is commenced in step 206. This control is practically made by controlling the opening degree of the steam inlet valve 16 for the turbine in accordance with the acceleration rate $\alpha$ as obtained through performing the programs of FIGS. 4*a* to 4*e*. Referring again to FIGS. 8*a* and 8*b*, the bearing oil temperature $\theta_2$ during acceleration is checked. As will be seen from FIG. 1, the total weight of the turbine is born by bearings 17 which is adapted to be supplied with a lubricating oil. The temperature of this lubricating oil is closely related to the turbine speed, and is controlled to provide an optimum viscosity of the oil in accordance with the turbine speed. More specifically, the lubricating oil is recirculated to the bearings 17 after having been cooled by an oil cooler 18. To perform this control of the bearing oil temperature, the rate of supply of the cooling medium to the oil cooler 18 is controlled by adjusting the opening degree of a valve 21 in accordance with the temperature of the oil detected by a detector 255.

The bearing oil temperature must be strictly optimum for the turbine speed at each moment, for otherwise the bearing would be damaged by overheating or an oil-whip. Therefore, it is necessary to check the bearing oil temperature during increasing the turbine speed.

The bearing oil temperature is a function of a loss caused by a viscous resistance as the turbine rotor rotates, and is determined mainly by the design of pipings including the oil tank 19. Thus, the function does not largely depend on the change in the characteristic of the loss. Therefore, the bearing oil temperature is preferably stored as a function of warming speed and time, as well as of the turbine speed during acceleration, for checking the oil temperature in the course of acceleration.

Figure 10:
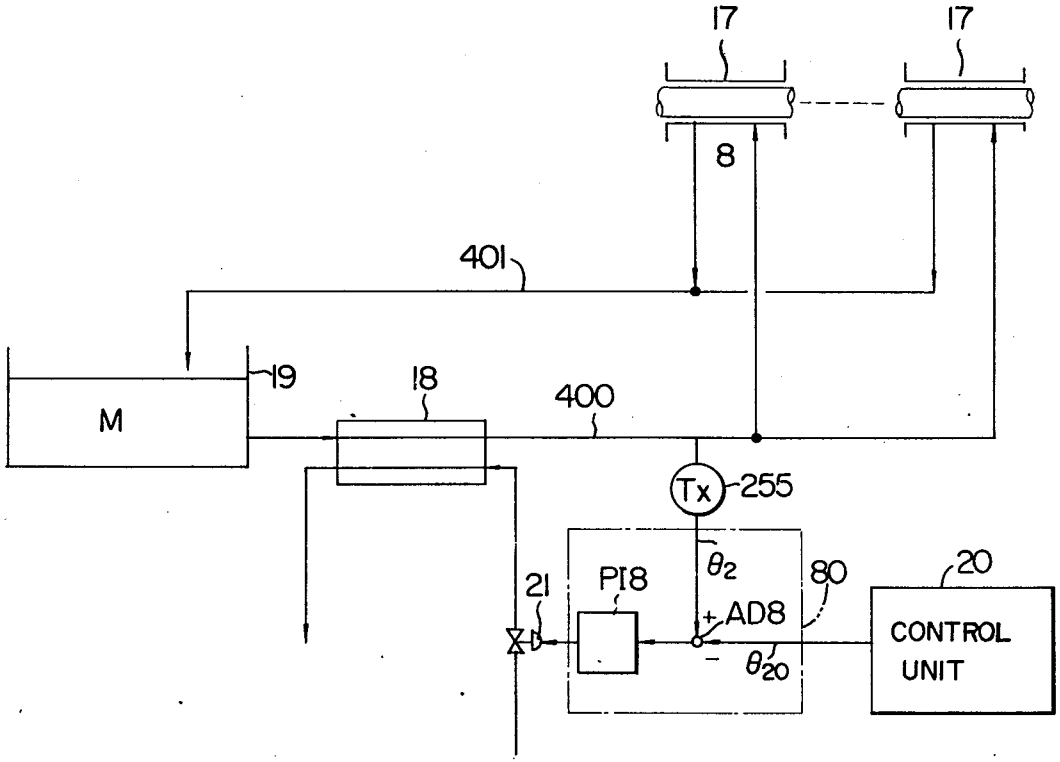
FIG. 10 shows a system for controlling the temperature of the bearing oil of the turbine.

Referring to FIG. 10 showing a system for controlling the bearing oil temperature, which is an enlarged and detailed representation of the controller 80 of FIG. 1. The system incorporates an adder AD8 adapted to determine the differential between a set or command value $\theta_{20}$ and the actual bearing oil temperature $\theta_2$. The differential is input to a proportional integration controller PI8 which outputs a signal corresponding to the differential by which the valve 21 is controlled. In the method of the invention, the bearing oil temperature is optimized by changing the command value $\theta_{20}$.

Referring to 8b, a limit value $\theta_l$ for the bearing oil at the moment when the turbine speed is N is calculated as a function of speed N. Subsequently, the detected bearing oil temperature $\theta_2$ is compared with the calculated limit temperature $\theta_{2o}$ in step 302.

The set value of the bearing temperature is then determined for that moment, when $\theta_2$ is determined larger than the $\theta_l$. The determination of the command for the bearing oil temperature $\theta_2$ is made by the following equation. Since the bearing oil temperature in general is in proportion to the turbine speed, the temperature can be expressed by $\theta_{2o} = k_1 \cdot N + k_2$, where $k_1$ and $k_2$ are constants.

When the detected temperature $\theta_2$ is determined to be smaller than $\theta_l$, there is a fear that an extraordinary accident such as an oil whip may occur to damage the turbine. Therefore, the bearing oil temperature must be raised as soon as possible. For this purpose, an operation is performed in step 304 in accordance with an equation of: $\Delta\theta_2 = \theta_l - \theta_2 + \theta_{60}$, where $\theta_{60}$ is a positive value in usual case as determined as required. Subsequently, an operation of $\theta_{2o} = \theta_{2o} + \Delta\theta_2$ is performed in step 305, thereby to raise the command value $\theta_{2o}$ to recover the bearing oil inlet temperature.

The programs of the controlling means of the present invention functions in the manner as described above.

The most critical feature of the method of the invention as detailed above resides in that the instant of advancement of the program for acceleration is determined on an assumption that the maximum value of the thermal stress resulted by acceleration of the turbine at a rate does not exceed a limit $\sigma o$ of the thermal stress.

The second feature resides in that the sum of the duration of time until the advancement of the program is commenced and the duration of time required for the advancement to be completed is calculated for each of a plurality of acceleration rates, to make it possible to advance the program with a pattern which provides minimum sum of time durations.

For the third point of advantage, the method of the present invention can be carried out relying upon a parameter of a load on the turbine, not only on the parameter of turbine speed as described. When the load on the turbine is used as the parameter for the control of the turbine, the principle of the invention is equally applicable for the turbine control when the load is being decreased, not only for the increasing load.

Although not specifically mentioned before, it is possible to experientially grasp the procedure and the time for starting up the turbine, as the turbine is started and stopped repeatedly. In such a case, it is not always necessary to perform the calculations for all patterns as performed in the described embodiment. Namely, in some cases, a mere completion of the starting-up within an expected length of time is required. In such a case, a determination of a pattern which provides the completion of the starting up within the length of time sufficies, and calculations for obtaining the minimum length of time for the completion can be dispensed with.

What is claimed is:

1. A method of running a steam turbine for shifting the mode of running from a first condition to a second condition through controlling the amount of steam supplied to said steam turbine, comprising the steps of estimating thermal stresses expected in said steam turbine when said mode is shifted at an assumed rate, determining a starting point of time for shifting the running mode such that the maximum value of said estimated thermal stresses becomes less than a predetermined limit of thermal stress, and shifting the mode at said starting point of time at the assumed rate.

2. A method of running a steam turbine as claimed in claim 1, further comprising the step of controlling the temperature of bearing oil supplied to bearings of said steam turbine dependent upon the speed of said steam turbine.

3. A method of running a steam turbine as claimed in claim 1, further comprising the step of controlling the temperature of steam supplied to said steam turbine dependent upon the magnitude of the thermal stress generated in said steam turbine in the process of shifting the mode from said first condition to said second condition.

4. A method of running a steam turbine as claimed in claim 3, further comprising the step of controlling the temperature of bearing oil supplied to bearings of said steam turbine dependent upon the speed of said steam turbine.

5. A method of running a steam turbine as claimed in claim 1, wherein said mode of running is a load applied to said steam turbine.

6. A method of running a steam turbine as claimed in claim 5, further comprising the step of controlling the temperature of bearing oil supplied to bearings of said steam turbine dependent upon the speed of said steam turbine.

7. A method of running a steam turbine as claimed in claim 5, further comprising the step of controlling the temperature of steam supplied to said steam turbine dependent upon the magnitude of the thermal stress generated in said steam turbine in the process of shifting the mode from said first condition to said second condition.

8. A method of running a steam turbine as claimed in claim 7, further comprising the step of controlling the temperature of bearing oil supplied to bearings of said steam turbine dependent upon the speed of said steam turbine.

9. A method of running a steam turbine as claimed in claim 1, wherein said mode of running is a speed of said steam turbine.

10. A method of running a steam turbine as claimed in claim 9, further comprising the step of controlling the temperature of bearing oil supplied to bearings of said steam turbine dependent upon the speed of said steam turbine.

11. A method of running a steam turbine as claimed in claim 9, further comprising the step of controlling the temperature of steam supplied to said steam turbine dependent upon the magnitude of the thermal stress generated in said steam turbine in the process of shifting the mode from said first condition to said second condition.

12. A method of running a steam turbine as claimed in claim 11, further comprising the step of controlling the temperature of bearing oil supplied to bearings of said steam turbine dependent upon the speed of said steam turbine.

13. A method of running a steam turbine for shifting the mode of running from a first condition to a second condition through controlling the amount of steam supplied to said steam turbine, comprising the steps of estimating thermal stresses expected in said steam turbine when said mode is shifted at each of a plurality of assumed rates, determining for each assumed rate the starting points of time for shifting the running mode such that each of the maximum values of said estimated thermal stresses becomes less than a predetermined limit of thermal stress, finding a sum of a duration of time required for shifting said mode from said first condition to said second condition at each of said assumed rates and a starting point of time for shifting the running mode at each of said assumed rates, and shifting the mode at such rate from such starting point of time that said sum is the smallest one.

14. A method of running a steam turbine as claimed in claim 13, further comprising the step of controlling the temperature of bearing oil supplied to bearings of said steam turbine dependent upon the speed of said steam turbine.

15. A method of running a steam turbine as claimed in claim 13, further comprising the step of controlling the temperature of steam supplied to said steam turbine dependent upon the magnitude of the thermal stress generated in said steam turbine in the process of shifting the mode from said first condition to said second condition.

16. A method of running a steam turbine as claimed in claim 15, further comprising the step of controlling the temperature of bearing oil supplied to bearings of said steam turbine dependent upon the speed of said steam turbine.

17. A method of running a steam turbine as claimed in claim 13, wherein said mode of running is a speed of said steam turbine.

18. A method of running a steam turbine as claimed in claim 17, further comprising the step of controlling the temperature of bearing oil supplied to bearings of said steam turbine dependent upon the speed of said steam turbine.

19. A method of running a steam turbine as claimed in claim 17, further comprising the step of controlling the temperature of steam supplied to said steam turbine dependent upon the magnitude of the thermal stress generated in said steam turbine in the process of shifting the mode from said first condition to said second condition.

20. A method of running a steam turbine as claimed in claim 19, further comprising the step of controlling the temperature of bearing oil supplied to bearings of said steam turbine dependent upon the speed of said steam turbine.

21. A method of running a steam turbine as claimed in claim 13, wherein said mode of running is a load applied to said steam turbine.

22. A method of running a steam turbine as claimed in claim 21, further comprising the step of controlling the temperature of bearing oil supplied to bearings of said steam turbine dependent upon the speed of said steam turbine.

23. A method of running a steam turbine as claimed in claim 21, further comprising the step of controlling the temperature of steam supplied to said steam turbine dependent upon the magnitude of the thermal stress generated in said steam turbine in the process of shifting the mode from said first condition to said second condition.

24. A method of running a steam turbine as claimed in claim 23, further comprising the step of controlling the temperature of bearing oil supplied to bearings of said steam turbine dependent upon the speed of said steam turbine.

25. A method of running a steam turbine for shifting the mode of running from a first condition to a second condition through controlling the amount of steam supplied to said steam turbine, comprising the steps of estimating thermal stresses expected in said steam turbine when said mode is shifted at an assumed rate, determining a starting point of time for shifting the running mode such that the maximum value of said estimated thermal stresses becomes less than a predetermined limit of thermal stress, finding a sum of said starting point of time and a duration of time required for shifting said mode from said first condition to said second condition at said shifting rate and shifting said mode at said shifting rate from said starting point of time when said sum is within a predetermined duration of time.

26. A method of running a steam turbine as claimed in claim 25, further comprising the step of controlling the temperature of bearing oil supplied to bearings of said steam turbine dependent upon the speed of said steam turbine.

27. A method of running a steam turbine as claimed in claim 25, further comprising the step of controlling the temperature of steam supplied to said steam turbine dependent upon the magnitude of the thermal stress generated in said steam turbine in the process of shifting the mode from said first condition to said second condition.

28. A method of running a steam turbine as claimed in claim 27, further comprising the step of controlling the temperature of bearing oil supplied to bearings of said steam turbine dependent upon the speed of said steam turbine.

29. A method of running a steam turbine as claimed in claim 25, wherein said mode of running is a load applied to said steam turbine.

30. A method of running a steam turbine as claimed in claim 29, further comprising the step of controlling the temperature of bearing oil supplied to bearings of said steam turbine dependent upon the speed of said steam turbine.

31. A method of running a steam turbine as claimed in claim 29, further comprising the step of controlling the temperature of steam supplied to said steam turbine dependent upon the magnitude of the thermal stress generated in said steam turbine in the process of shifting the mode from said first condition to said second condition.

32. A method of running a steam turbine as claimed in claim 31, further comprising the step of controlling the temperature of bearing oil supplied to bearings of said steam turbine dependent upon the speed of said steam turbine.

33. A method of running a steam turbine as claimed in claim 25, wherein said mode of running is a speed of said steam turbine.

34. A method of running a steam turbine as claimed in claim 33, further comprising the step of controlling the temperature of bearing oil supplied to bearings of said steam turbine dependent upon the speed of said steam turbine.

35. A method of running a steam turbine as claimed in claim 33, further comprising the step of controlling the temperature of steam supplied to said steam turbine dependent upon the magnitude of the thermal stress generated in said steam turbine in the process of shifting the mode from said first condition to said second condition.

36. A method of running a steam turbine as claimed in claim 35, further comprising the step of controlling the temperature of bearing oil supplied to bearings of said steam turbine dependent upon the speed of said steam turbine.

* * * * *